US011054757B2

(12) United States Patent
Kitagawa et al.

(10) Patent No.: US 11,054,757 B2
(45) Date of Patent: Jul. 6, 2021

(54) TONER, IMAGE FORMING APPARATUS, IMAGE FORMING METHOD, AND PROCESS CARTRIDGE

(71) Applicants: Yohichi Kitagawa, Shizuoka (JP); Keiji Makabe, Shizuoka (JP); Yuka Mizoguchi, Shizuoka (JP); Tsuneyasu Nagatomo, Shizuoka (JP); Shinya Nakayama, Shizuoka (JP)

(72) Inventors: Yohichi Kitagawa, Shizuoka (JP); Keiji Makabe, Shizuoka (JP); Yuka Mizoguchi, Shizuoka (JP); Tsuneyasu Nagatomo, Shizuoka (JP); Shinya Nakayama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/583,861

(22) Filed: Sep. 26, 2019

(65) Prior Publication Data

US 2020/0103775 A1 Apr. 2, 2020

(30) Foreign Application Priority Data

Sep. 27, 2018 (JP) ..... JP2018-181271
Oct. 31, 2018 (JP) ..... JP2018-204925

(51) Int. Cl.
*G03G 9/087* (2006.01)
*G03G 9/08* (2006.01)
(Continued)

(52) U.S. Cl.
CPC ..... *G03G 9/08755* (2013.01); *G03G 9/0819* (2013.01); *G03G 9/0827* (2013.01); *G03G 15/08* (2013.01); *G03G 21/1814* (2013.01)

(58) Field of Classification Search
CPC ..... G03G 9/09708; G03G 9/09716; G03G 9/09725
See application file for complete search history.

(56) References Cited

U.S. PATENT DOCUMENTS 7,172,844 B2 2/2007 Umemura et al.
9,557,669 B2 1/2017 Nagai et al.
(Continued)

FOREIGN PATENT DOCUMENTS

JP 2006-201706 8/2006
JP 2009-236936 10/2009
JP 2014-178528 9/2014

*Primary Examiner* — Peter L Vajda
(74) *Attorney, Agent, or Firm* — Oblon, McClelland, Maier & Neustadt, L.L.P.

(57) ABSTRACT

A toner including toner base particles each including a binder resin and a colorant, and external additive, wherein the toner satisfies conditions (a), (b), and (c) below:

(a) storage elastic modulus G'(50) of the toner at 50° C. and storage elastic modulus G'(90) of the toner at 90° C. satisfy Formula (1);

$$G'(50)/G'(90) \geq 6.0\times10^2 \quad \text{Formula (1)}$$

(b) a BET specific surface area Bt($m^2$/g) of the toner and a coverage Ct (%) of the toner base particles covered with the external additive satisfy Formula (2); and $$Bt-0.03\times Ct \leq 1.60 \quad \text{Formula (2)}$$

(c) the external additive includes at least cohered particles, the cohered particles are non-spherical secondary particles each formed through cohesion of primary particles, and a number average secondary particle diameter of the cohered particles is 130 nm or greater.

6 Claims, 3 Drawing Sheets

(51) Int. Cl.
*G03G 21/18* (2006.01)
*G03G 15/08* (2006.01)

(56) References Cited

U.S. PATENT DOCUMENTS

| | | | | |
|---|---|---|---|---|
| 9,804,515 | B2 | 10/2017 | Sugiura et al. | |
| 2002/0009313 | A1* | 1/2002 | Okamura | G03G 15/065 399/286 |
| 2007/0190444 | A1 | 8/2007 | Kotsugai et al. | |
| 2007/0218387 | A1 | 9/2007 | Ishii et al. | |
| 2009/0067876 | A1 | 3/2009 | Seshita et al. | |
| 2010/0196811 | A1* | 8/2010 | Gottschalk-Gaudig | C09C 1/3081 430/105 |
| 2011/0081608 | A1 | 4/2011 | Yaguchi et al. | |
| 2013/0115550 | A1 | 5/2013 | Amemori et al. | |
| 2013/0157184 | A1 | 6/2013 | Sugimoto et al. | |
| 2013/0243488 | A1 | 9/2013 | Kojima et al. | |
| 2013/0244155 | A1 | 9/2013 | Satoh et al. | |
| 2013/0244156 | A1 | 9/2013 | Kojima et al. | |
| 2014/0072349 | A1 | 3/2014 | Sakashita et al. | |
| 2014/0140731 | A1 | 5/2014 | Hozumi et al. | |
| 2014/0234767 | A1 | 8/2014 | Awamura et al. | |
| 2014/0255840 | A1* | 9/2014 | Sekiguchi | G03G 9/08793 430/105 |
| 2014/0270874 | A1 | 9/2014 | Hase et al. | |
| 2015/0104739 | A1 | 4/2015 | Nagatomo et al. | |
| 2015/0378272 | A1 | 12/2015 | Hase et al. | |
| 2016/0266507 | A1 | 9/2016 | Watanabe et al. | |
| 2016/0334722 | A1* | 11/2016 | Makabe | G03G 9/08755 |
| 2017/0242358 | A1* | 8/2017 | Kawamura | G03G 9/0825 |

* cited by examiner

TONER, IMAGE FORMING APPARATUS, IMAGE FORMING METHOD, AND PROCESS CARTRIDGE

CROSS-REFERENCE TO RELATED APPLICATIONS

The present application claims priority under 35 U.S.C. § 119 to Japanese Patent Application No. 2018-181271 filed Sep. 27, 2018 and Japanese Patent Application No. 2018-204925 filed Oct. 31, 2018. The contents of which are incorporated herein by reference in their entirety.

BACKGROUND OF THE INVENTION

Field of the Invention

The present disclosure relates to a toner, an image forming apparatus, an image forming method, and a process cartridge.

Description of the Related Art

In recent years, it is required for toners have low-temperature fixing ability for energy saving, and heat resistant storage stability resistant to high-temperature and high-humidity environment during storage or at the time of transportation. Since energy consumption during fixing occupies majority of energy consumption for an image forming process, improvement in low-temperature fixing ability is particularly very important.

In order to achieve energy saving, a toner that can be fixed at a lower temperature than a conventional fixing temperature has been produced by using crystalline polyester as a binder resin of the toner for the purpose of lowering a glass transition temperature.

Use of crystalline polyester however makes a toner melt at a low temperature. Therefore, storage stability of the toner against a high-temperature high-humidity environment tends to deteriorate. Moreover, shapes of toner particles tend to change to accelerate embedding of external additives, which deteriorate flowability of the toner. As a result, a system problem, such as a cleaning failure, tends to occur. To realize both low-temperature fixing ability and storage stability, and to realize a desirable cleaning process are major problems to solve.

To solve the above-described problems, proposed is a toner for suppressing a change in an amount of free silica using non-spherical silica having a high spacer effect as an external additive of the toner (see, for example, Japanese Unexamined Patent Application Publication No. 2014-178528).

SUMMARY OF THE INVENTION

According to one aspect of the present disclosure, a toner includes toner base particles and external additive. The toner base particles each include a binder resin and a colorant. The toner satisfies conditions (a), (b), and (c) below:

(a) storage elastic modulus G'(50) of the toner at 50° C. and storage elastic modulus G'(90) of the toner at 90° C. satisfy Formula (1):

$$G'(50)/G'(90) \geq 6.0\times10^2 \quad \text{Formula (1)}$$

(b) a BET specific surface area Bt($m^2$/g) of the toner and a coverage Ct (%) of the toner base particles covered with the external additive satisfy Formula (2):

$$Bt-0.03\times Ct \leq 1.60 \quad \text{Formula (2)}$$

(c) the external additive includes at least cohered particles, the cohered particles are non-spherical secondary particles each formed through cohesion of primary particles, and a number average secondary particle diameter of the cohered particles is 130 nm or greater.

DETAILED DESCRIPTION OF THE INVENTION (Toner)

Figure 1:
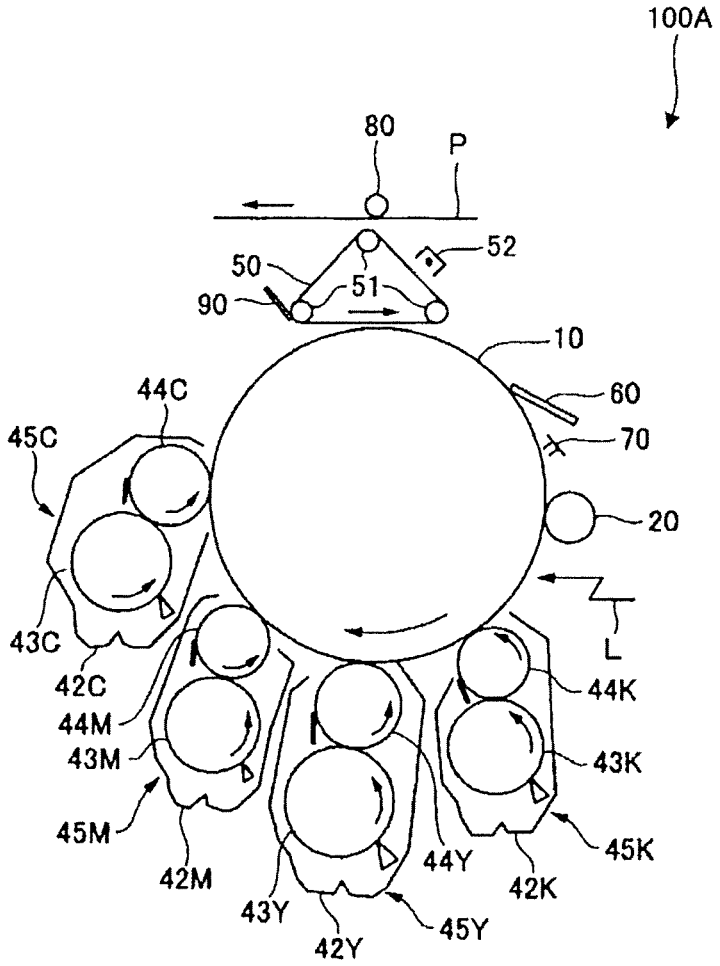
FIG. 1 is a schematic view illustrating one example of an image forming apparatus of the present disclosure.

A toner of the present disclosure include toner base particles each including a binder resin and a colorant, and external additive. The toner satisfies conditions (a), (b), and (c) below:

(a) storage elastic modulus G'(50) of the toner at 50° C. and storage elastic modulus G'(90) of the toner at 90° C. satisfy Formula (1):

$$G'(50)/G'(90) \geq 6.0\times10^2 \quad \text{Formula (1)}$$

(b) a BET specific surface area Bt($m^2$/g) of the toner and a coverage Ct (%) of the toner base particles covered with the external additive satisfy Formula (2):

$$Bt-0.03\times Ct \leq 1.60 \quad \text{Formula (2)}$$

(c) the external additive includes at least cohered particles, the cohered particles are non-spherical secondary particles each formed through cohesion of primary particles, and a number average secondary particle diameter of the cohered particles is 130 nm or greater.

In case of the toner of the related art, an external additive is embedded in surfaces of the toner particles because a contact area between the external additive and the toner is large, and hence there is a problem that heat resistant storage stability, durability, flowability, and cleaning properties are deteriorated.

The present inventors have diligently conducted researches and as a result have had the following insight. That is, a toner satisfying all of the conditions (a), (b), and (c) has a small contact area between a toner base particle and an external additive, and therefore the external additive can be prevented from being embedded in surfaces of the toner base particles that are fixed at a low temperature.

Moreover, the present inventors have found that the toner satisfying all of the conditions (a), (b), and (c) has excellent low-temperature fixing ability, heat resistant storage stability, durability, and cleaning properties.

Each of the conditions (a), (b), and (c) will be described below.

The present disclosure has an object to provide a toner that prevents embedding of external additive into surfaces of toner particles, and has excellent low-temperature fixing ability, heat resistant storage stability, durability, and cleaning properties.

The present disclosure can provide provide a toner that prevents embedding of external additive into surfaces of toner particles, and has excellent low-temperature fixing ability, heat resistant storage stability, durability, and cleaning properties.

The toner of the present disclosure satisfies the condition (a). Specifically, a storage elastic modulus G'(50) of the toner at 50° C. and a storage elastic modulus G'(90) of the toner at 90° C. satisfy Formula (1).

$$G'(50)/G'(90) \geq 6.0 \times 10^2 \quad \text{Formula (1)}$$

The toner satisfying Formula (1) can achieve sharp melting that can realize both low-temperature fixing ability and heat resistant storage stability of the toner at a high level.

Note that, the toner that does not satisfy the condition (a) toner, i.e., the toner that does not satisfy Formula (1), has low sharp melting characteristics of the toner and therefore cannot achieve high low-temperature fixing ability.

The toner of the present disclosure satisfies the condition (b). Specifically, a BET specific surface area Bt ($m^2/g$) of the toner and a coverage Ct (%) of the toner base particles covered with the external additive satisfy Formula (2).

$$Bt - 0.03 \times Ct \leq 1.60 \quad \text{Formula (2)}$$

The toner satisfying Formula (2) includes toner base particles each having the smaller surface area than that of toner base particle of a conventional toner, and therefore the toner has a small contact area with the external additive. Accordingly, the external additive can be prevented from being embedded in surfaces of the toner base particles that are fixed at a low temperature. Moreover, the toner can achieve excellent heat resistant storage stability, durability, flowability, and cleaning properties.

In case of the toner that does not satisfy the condition (b), i.e., the toner that does not satisfy Formula (2), a contact area between a surface of each toner base particle and external additive increases in a low-temperature fixing toner, the external additive is embedded in surfaces of the toner base particles, to thereby deteriorate heat resistant storage stability, durability, flowability, and cleaning properties.

Since the external additive is embedded, moreover, a surface area of a toner base particle to be exposed increases, adhesion between toner particles and adhesion of the toner with a photoconductor or a transfer belt increase, and heat resistant storage stability, durability, flowability, and cleaning properties are deteriorated.

The derivation process of Formula (2) is as follows.

The BET specific surface area Bt of the toner is obtained as a value including surface roughness of toner base particles, and surface roughness of external additive.

When coverage of the toner is determined as Ct %, where each toner base particle is covered with external additive, and the BET specific surface area of the toner is from about 20 $m^2/g$ through about 200 $m^2/g$, an amount of increase in the BET specific surface area of the toner relative to the BET specific surface area of the toner base particles is roughly $0.03 \times Ct$ $m^2/g$. When a relationship between the BET specific surface area Bt of the toner and the coverage Ct is depicted in a graph based on the measured values, a coefficient including Formula (2), 0.03, is calculated.

Accordingly, a value of the BET specific surface area of the base particles can be estimated by putting $Bt - 0.03 \times Ct$ in the left side of Formula (2).

The toner of the present disclosure satisfies the condition (c). Specifically, the external additive includes at least cohered particles, and the cohered particles are non-spherical secondary particles obtained through cohesion of primary particles, and the number average secondary particle diameter of the cohered particles is 130 nm or greater.

The toner satisfying the condition (c) can prevent liberation or embedding of the external additive caused by friction between toner particles or between the toner particles with carrier, and can prevent embedding of the external additive on a surface of a toner particle fixed at a low temperature, compared to a general toner. Moreover, heat resistant storage stability, durability, flowability, and cleaning properties can be achieved.

In case of the toner that does not satisfy the condition (c), i.e., the toner including the external additive that is spherical and has the number average secondary particle diameter of less than 130 nm, the external additive is embedded in a surface of each particle of a low-temperature fixing toner, and therefore heat resistant storage stability, durability, flowability, and cleaning properties are deteriorated.

The adhesion A (gf) between deteriorated toner particles when being compressed at 16 $kg/cm^2$, after stirring and mixing 30 g of a developer including the toner for 60 minutes at the frequency of 700 rpm by means of a rocking mill, preferably satisfies Formula (3).

$$A < 300 \quad \text{Formula (3)}$$

In case of the toner satisfying Formula (3), adhesion between toner particles, and between the toner and a photoconductor or transfer belt is low, and therefore heat resistant storage stability, durability, flowability, and cleaning properties can be improved.

By performing a stirring treatment using a rocking mill, moreover, liberation or embedding of the external additive caused by friction between toner particles or between the toner particles and the carrier inside an actual device can be reproduced. Moreover, high quality can be assured by controlling the adhesion between deteriorated toner particles.

The total energy after stirring and mixing 30 g of a developer including the toner for 60 minutes at the frequency of 700 rpm is preferably 200 mJ or greater but 350 mJ or less.

The amount B (% by mass) of the external additive from the toner when 3.75 g of the toner is dispersed in 50 mL of a 0.5% by mass polyoxyalkylene alkyl ether dispersion liquid in a 110 mL vial, and ultrasonic waves are applied for 1 minute at 20 kHz and 750 W preferably satisfies Formula (4).

$$B > 0.8 \quad \text{Formula (4)}$$

In case of the toner satisfying Formula (4), the external additive is sufficiently liberated from the toner on the photoconductor, and therefore a deposited layer (dam layer) of the external additive is formed at a nip with the cleaning blade, thus high cleaning properties can be obtained.

<External Additive>

The toner includes an external additive.

The external additive includes at least cohered particles, and may further include other ingredients.

<<Cohered Particles>>

The cohered particles are non-spherical secondary particles each formed by cohesion of primary particles.

The number average secondary particle diameter of the cohered particles is 130 nm or greater.

Examples of the cohered particles include non-spherical silica.

—Primary Particles—

The average particle diameter (Da) of the primary particles is not particularly limited and may be appropriately selected depending on the intended purpose. The average particle diameter (Da) thereof is preferably 20 nm or greater but 150 nm or less, and more preferably 35 nm or greater but 150 nm or less.

When the average particle diameter (Da) of the primary particles is 20 nm or greater, the secondary particles function as spacers and therefore the external additive is prevented from being embedded in the toner base particles as external stress is applied. When the average particle diameter (Da) of the primary particles is 150 nm or less, the external additive is prevented from being released from the toner and therefore filming on a photoconductor can be prevented.

The average particle diameter (Da) of the primary particles can be measured based on particle diameters of primary particles in the secondary particles.

For example, the average particle diameter (Da) of the primary particles can be measured in the following manner. First, secondary particles are dispersed in an appropriate solvent, such as tetrahydrofuran (THF), followed by removing the solvent on a substrate, to thereby produce a dried and solidified sample. Next, the obtained sample is observed under a field emission scanning electron microscope (FE-SEM, accelerating voltage: 5 kV or greater but 8 kV or less, observation magnification: 8,000 times or greater but 10,000 times or less) and the maximum length of each of cohesive primary particles within a field of view is measured. The number of particles to be measured is 100 particles or greater but 200 particles or less. The average value of the maximum lengths of the primary particles measured is calculated and determined as the average particle diameter of the primary particles.

—Secondary Particles—

The secondary particles are non-spherical and formed by cohesion of primary particles.

The number average particle diameter (number average secondary particle diameter) of the secondary particles is 130 nm or greater.

Examples of the secondary particles include non-spherical silica formed by cohesion of primary particles of silica.

The non-spherical silica is secondary particles formed by cohesion of primary particles of silica.

The non-spherical silica is not particularly limited and may be appropriately selected depending on the intended purpose, as long as the non-spherical silica is particles obtained by causing the below-mentioned primary particles chemically bonded with a processing agent and secondary aggregated. The non-spherical silica is preferably obtained by a sol-gel method.

The average particle diameter (Db) of the secondary particles is not particularly limited. The average particle diameter (Db) thereof is preferably 80 nm or greater but 200 nm or less, more preferably 100 nm or greater but 180 nm or less, and particularly preferably 100 nm or greater but 160 nm or less.

When the average particle diameter thereof is 80 nm or greater, the external additive effectively functions as a spacer, and the external additive can be prevented from being embedded in toner base particles. When the average particle diameter is 200 nm or less, the external additive is prevented from being released from the toner, the released silica is prevented from depositing on a photoconductor, and therefore the toner has excellent filming resistance. When the average particle diameter thereof 80 nm or greater but 200 nm or less, moreover, it is advantageous because the external additive is prevented from being embedded in the toner, and flowability and transfer properties are improved.

For example, the average particle diameter (Db) of the secondary particles can be measured in the following manner. Next, the obtained sample is observed under a field emission scanning electron microscope (FE-SEM, accelerating voltage: 5 kV or greater but 8 kV or less, observation magnification: 8,000 times or greater but 10,000 times or less) and the maximum lengths of the secondary particles within a field of view is measured. The number of particles to be measured is 100 particles or greater but 200 particles or less. The average value of the maximum lengths of the secondary particles measured is calculated and determined as the average particle diameter of the secondary particles.

—Degree of Cohesion of Secondary Particles—

A degree of cohesion (G) of each of secondary particles is represented by a ratio (particle diameter of secondary particle/average particle diameter of primary particles) of a particle diameter of the secondary particle to the average particle diameter of the primary particles included in the secondary particle.

The particle diameter of the second particle and the average particle diameter of the primary particles are measured and calculated by the above-described method.

The degree of cohesion (G) is arbitrary controlled, after adjusting a primary particle diameter, by a type and amount of a below-mentioned processing agent and processing conditions.

The average value of the degree of cohesion (G) (particle diameter of secondary particle/average particle diameter of primary particles) of the secondary particles is not particularly limited and may be appropriately selected depending on the intended purpose. The average value thereof is preferably 1.5 or greater but 4.0 or less, and more preferably 2.0 or greater but 3.0 or less.

When the average value of the degree of cohesion (G) is 1.5 or greater, the external additive is prevented from rolling into recess portions of surfaces of the toner base particles and being embedded in the toner base particles, and therefore excellent transfer properties of the toner is obtained. When the average value of the degree of cohesion (G) is 4.0 or less, the external additive is prevented from being released from the toner, and therefore reduction in charging and scratches on a photoconductor caused due to carrier contamination can be prevented, and image defects over time can be prevented.

An amount of the secondary particles having the degree of cohesion of less than 1.3 is not particularly limited and may be appropriately selected depending on the intended purpose. The amount thereof is preferably 10% by number relative to a total amount of the secondary particles in the toner.

The secondary particles have a distribution because of production thereof. Particles the degree of cohesion of which is less than 1.3 are particles that are not cohesive and are present as a substantially spherical state. Accordingly, it is hard for such particles to exhibit a function as irregular additive for preventing from embedding.

A measurement of an amount of the secondary particles the degree of cohesion which is less than 1.3 can be measured by measuring particles diameters of the primary particles and the secondary particles among 100 particles or greater but 200 particles or less according to the above-described method, calculating a degree of cohesion of each secondary particle from the obtained measurement value, and dividing the number of particles the degree of cohesion of which is less than 1.3 with the number of the particles measured.

—Index Related to Stirring of Secondary Particles—

The secondary particles are not particularly limited and may be appropriately selected depending on the intended purpose. The secondary particles preferably satisfy Formula (ii) below because aggregation force (cohesive force) between primary particles is maintained under constant stirring conditions to enhance durability of a resultant toner. The secondary particles more preferably satisfy Formula (ii-1) below.

$$Nx/1{,}000\times100\leq30\% \quad \text{Formula (ii)}$$

$$Nx/1{,}000\times100\leq20\% \quad \text{Formula (ii-1)}$$

In Formulae (ii) and (ii-1), Nx is the number of primary particles present as single particles in a region where 1,000 secondary particles are observed when 0.5 g of the secondary particles and 49.5 g of the carrier placed in a 50 mL bottle were stirred by a mixing stirrer for 10 minutes at 67 Hz, followed by observing under a scanning electron microscope.

When the aggregation force of the secondary particles is strong, the number of particles turned into primary particles through cracking or breaking of the external additive in the toner due to load applied by a developing device is small, embedding or rolling of the external additive is prevented, and therefore a high transferring rate can be maintained over time.

When the aggregation force of the secondary particles is weak (the case where a ratio of the primary particles present as single particles is greater than 30% relative to 1,000 second particles), the number of particles turned into primary particles through cracking or breaking of the external additive in the toner due to load applied by a developing device is large, the ratio of spherical primary particles increases, moving or embedding of the external additive tends to occur, and it is difficult to maintain a high transferring rate over time.

When the primary particles are particles having excessively small particle diameters (e.g., less than 80 nm), the external additive tends to be embedded in toner base particles, and the external additive tends to roll into recesses, and therefore transfer properties and charging ability may not be able to maintain. When the primary particles are particles having excessively large particle diameters (e.g., greater than 200 nm), the external additive tends to be detached from the toner, and image defects may be formed over time due to reduction in charging caused by contamination of carrier, and scratched formed in a photoconductor.

In the formulae (ii) and (ii-1), the primary particles means particles present as single particles without causing cohesion of the particles after the secondary particles are stirred by the mixing stirrer under the above-described stirring conditions. The primary particles include particles turned into primary particles as a result of cracking or breaking after the stirring, and particles present as the single primary particles even before the stirring, and include particles where the primary particles are not cohesive to each other.

In Formulae (ii) and (ii-1), shapes of the primary particles are not particularly limited and may be appropriately selected depending on the intended purpose, as long as shapes thereof are not shapes each formed by particles are cohesive to each other. The primary particles are often present as a substantially spherical state.

A method for confirming the existence of the primary particles in Formulae (ii) and (ii-1) is not particularly limited and may be appropriately selected depending on the intended purpose. Preferred is a method where particles are observed under a scanning electron microscope (SEM) to confirm that the particles are present as single particles.

A measuring method of the average particle diameter of the primary particles is not particularly limited and may be appropriately selected depending on the intended purpose. The average particle diameter of the primary particles can be performed by measuring (the number of particles to be measured: 100 particles or more) the average value of particles of the primary particles in a field of view under a scanning electron microscope (FE-SEM, accelerating voltage: 5 kV or greater but 8 kV or less, observation magnification: 8,000 times or greater but 10,000 times or less).

In Formulae (ii) and (ii-1), the number of the primary particles present as single particles among 1,000 secondary particles is measured by after the stirring, observing the particles under a scanning electron microscope, and counting, as one primary particle, a particle present as a single particle.

In the case where a secondary particle formed through cohesion of a plurality of particles is observed under the scanning electron microscope, the secondary particle is counted as one secondary particle.

In Formulae (ii) and (ii-1), a method for measuring the number of the primary particles present as single particles among 1,000 secondary particles is represented, for example, as the number of the primary particles per 1,000 secondary particles in an observation range when observation is performed particle concentration and observation magnification with which outlines of each of secondary particles and primary particles are distinguishable, under the scanning electron microscope. As the observation range, for example, a plurality of arbitrary of views or regions under the scanning electron microscope, preferably adjacent views or regions, are appropriately set in a manner that the secondary particles to be observed are to be 1,000 or greater.

The mixing stirrer is not particularly limited and may be appropriately selected depending on the intended purpose. For example, a rocking mill is used. Examples of the rocking mill include a rocking mill available from Kabushikigaisha Seiwa Giken.

The carrier is not particularly limited and may be appropriately selected depending on the intended purpose. As the carrier, preferably used is coated ferrite powder obtained by applying a coating layer forming solution of an acrylic resin or silicone resin including alumina powder onto a surface of fired ferrite powder and drying.

The 50 mL bottle is not particularly limited and may be appropriately selected depending on the intended purpose. Examples thereof include a commercially available glass bottle (available from TEST TUBES & VIALS NICHIDENRIKA GLASS CO., LTD.).

—Index of Particle Size Distribution of Secondary Particles—

An index of a particle size distribution of the secondary particles is not particularly limited and may be appropriately selected depending on the intended purpose. The index preferably satisfies Formula (iii) below particularly because a problem associated with cleaning of a toner can be solved. Use of particles having a sharp particle size distribution represented by Formula (iii) below as the secondary particles can give a toner having particularly excellent cleaning properties.

$$Db50/Db10\leq1.20 \quad \text{Formula (iii)}$$

In Formula (iii), Db50 is a particle diameter of the secondary particle with which a cumulative value is 50% by number, and Db10 is a particle diameter of the secondary particle which a cumulative value is 10% by number, when a cumulative distribution of the secondary particles is drawn from the side of small particles with setting a particle diameter (nm) of the secondary particle as a horizontal axis and the cumulative value (% by number) of the secondary particle as a vertical axis.

For example, the Db50 is represented by a cumulative distribution of the secondary particles when a particle diameter (nm) of the secondary particle is set as a horizontal axis and the cumulative value (% by number) of the secondary particles is set as a vertical axis, and is the $100^{th}$ particle when the number of the secondary particles measured is 200, and is the $75^{th}$ particle when the number of the secondary particles measured is 150.

For example, the Db50 can be measured by, after dispersing the secondary particles in an appropriate solvent, such as tetrahydrofuran (THF), removing the solvent on a substrate to solidify a sample, observing the sample under a field emission scanning electron microscope (FE-SEM, accelerating voltage: 5 kV or greater but 8 kV or less, observation magnification: 8,000 times or greater but 10,000 times or less) to measure particle diameters of the secondary particles in a field of view, and measuring the particle diameter of the secondary particle with which the cumulative value is 50%.

The particle diameter of the secondary particles can be measured by measuring the maximum length of the aggregated secondary particles (the number of particles measured: 100 particles or greater but 200 particles or less).

For example, the Db10 is represented by a cumulative distribution of the secondary particles when a particle diameter (nm) of the secondary particle is set as a horizontal axis and the cumulative value (% by number) of the secondary particles is set as a vertical axis, and is the $20^{th}$ particle when the number of the secondary particles measured is 200, and is the $15^{th}$ particle when the number of the secondary particles measured is 150.

For example, the Db10 can be measured by, after dispersing the secondary particles in an appropriate solvent, such as tetrahydrofuran (THF), removing the solvent on a substrate to solidify a sample, observing the sample under a field emission scanning electron microscope (FE-SEM, accelerating voltage: 5 kV or greater but 8 kV or less, observation magnification: 8,000 times or greater but 10,000 times or less) to measure particle diameters of the secondary particles in a field of view, and measuring the particle diameter of the secondary particle with which the cumulative value is 10%.

The particle diameter of the secondary particles can be measured by measuring the maximum length of the aggregated secondary particles (the number of particles measured: 100 particles or greater but 200 particles or less).

The ratio "Db50/Db10" is not particularly limited and may be appropriately selected depending on the intended purpose. The ratio thereof is preferably 1.00 or greater but 1.20 or less, and more preferably 1.00 or greater but 1.15 or less.

As the ratio "Db50/Db10" is closer to 1.00, it is more preferable because a shape of the particle size distribution becomes sharp, the number of uncohesive primary particles is small and the number of secondary particles in which diameters of cohered particles are small is small. When the ratio "Db50/Db10" is 1.20 or less, a particle size distribution of the secondary particles is not too wide, the number of particles having small particle diameter can be kept low. Specifically, it means that the number of both "Particles A having small particle diameters" (particles that are not cohesive and present as primary particles) and "Particles B having small particle diameters" (particles that are cohesive but includes primary particles having small particle diameters) is small.

When the amount of "Particles A having small particle diameters" is small, a function as a non-spherical external additive is exhibited, excellent embedding resistance is obtained, and therefore formation of abnormal images can be prevented.

When the amount of "Particles B having small particle diameters" is small, a function as a spacer effect is exhibited, external stress is reduced, and the external additive is presented from being embedded in toner base particles.

A method for reducing "Particles A having small particle diameters" and "Particles B having small particle diameters" is not particularly limited and may be appropriately selected depending on the intended purpose. The method is preferably a method where particles having small particle diameters are removed in advance by a classification treatment.

—Shapes of Secondary Particles—

A shape of each of the secondary particles is not particularly limited and may be appropriately selected depending on the intended purpose, as long as each secondary particle has a non-spherical shape formed of cohesion of particles. Examples of the shape include a non-spherical shape formed of cohesion of two or more particles.

Use of the secondary particles can realize high flowability of the toner, and can maintain a high transferring rate over a long period because embedding and rolling of the external additive are presented when load is applied to the toner through stirring inside a developing device. Moreover, the secondary particles maintain adhesion force (cohesive force) between particles even under constant stirring conditions, and therefore high durability of a toner can be obtained.

A method for confirming cohesion of primary particles in the secondary particle is not particularly limited and may be appropriately selected depending on the intended purpose. The method is preferably a method for confirming through observation under a field emission scanning electron microscope (FE-SEM).

—Production Method of Secondary Particles—

A production method of the secondary particles is not particularly limited and may be appropriately selected depending on the intended purpose. Examples thereof include a sol-gel method and a dry method. Among the above-listed examples, a production method using a sol-gel method is preferable.

Specifically, preferably is a method where the primary particles and a below-described processing agent are mixed and fired to chemically bond to each other to cause secondary aggregation, to thereby produce the secondary particles. When the secondary particles are synthesized by a sol-gel method, the processing agent is co-present, and secondary particles may be prepared by one-step reaction.

The secondary particles produced by the sol-gel method are preferable because particle diameter control is easier than that in a dry method, a sharp particle size distribution is obtained, and excellent moisture adsorption is obtained. Since the particle size distribution is sharp, moreover, embedding in the toner due to excessively small particle diameters thereof, or liberation from the toner due to excessively large particle diameters thereof can be prevented.

Moreover, the secondary particles produced by the sol-gel method are porous, which is not the case with dry silica, and absorb moisture. Therefore, influence of humidity on a polyester resin can be reduced, and prevention of shape changes and improvement of storage stability are expected.

——Processing Agent——

The processing agent is not particularly limited and may be appropriately selected depending on the intended purpose. Examples thereof include a silane-based processing agent, and an epoxy-based processing agent. The above-listed examples may be used alone or in combination.

In the case where primary particles of the silica are used, the silane-processing agent is preferable because Si—O—Si bonds the silane-based processing agent forms is more thermally stable than Si—O—C bonds the epoxy-based processing agent forms. Moreover, a processing aid (e.g., water, and a 1% by mass acetic acid aqueous solution) may be used according to the necessity.

———Silane-Based Processing Agent———

The silane-based processing agent is not particularly limited and may be appropriately selected depending on the intended purpose. Examples thereof include: alkoxy silanes (e.g., tetramethoxysilane, tetraethoxysilane, methyltrimethoxysilane, methyltriethoxysilane, dimethyldimethoxysilane, dimethyldiethoxysilane, methyldimethoxysilane, methyldiethoxysilane, diphenyldimethoxysilane, isobutyltrimethoxysilane, and decyltrimethoxysilane); silane coupling agent (e.g., γ-aminopropyltriethoxysilane, γ-glycidoxypropyltrimethoxysilane, γ-glycidoxypropylmethyldiethoxysilane, γ-methacryloxypropyltrimethoxysilane, γ-mercaptopropyltrimethoxysilane, vinyltriethoxysilane, and methylvinyldimethoxysilane); and mixtures of any of vinyltrichlorosilane, dimethyldichlorosilane, methylvinyldichlorosilane, methylphenyldichlorosilane, phenyltrichlorosilane, N,N'-bis(trimethylsilyl)urea, N,O-bis(trimethylsilyl)acetamide, dimethyltrimethylsilylamine, hexamethyldisilazane, or cyclic silazane.

As described below, the silane-based processing agent makes the primary particles chemically bonded to one another to form secondary aggregates.

In the case where the silica primary particles are treated using the alkoxysilanes, the silane-coupling agent, etc. as the silane-based processing agent, as demonstrated in Formula (A) below, a silanol group bonded to the silica primary particle is allowed to react with an alkoxy group bonded to the silane-based processing agent to form a new Si—O—Si bond through dealcoholization to thereby cause secondary aggregation.

In the case where the silica primary particles are treated using the chlorosilane as the silane-based processing agent, a chloro group of the chlorosilane and a silanol group bonded to the silica primary particles are allowed to react through a dehydrochlorination reaction to form a new Si—O—Si bond to cause secondary aggregation. In the case where the silica primary particles are treated using the chlorosilane as the silane-based processing agent, moreover, when water is co-present in the system, first, the chlorosilane causes hydrolysis with water to generate a silanol group, and the generated silanol group and a silanol group bonded to the silica primary particle are reacted through a dehydration reaction to form a new Si—O—Si bond, to thereby cause secondary aggregation.

In the case where the silica primary particles are treated using silazane as the silane-based processing agent, an amino group and a silanol group bonded to the silica primary particles are reacted through deammoniation to form a new Si—O—Si bond to thereby cause secondary aggregation.

—Si—OH+RO—Si—→—Si—O—Si—+ROH Formula (A)

In Formula (A) above, R is an alkyl group.

———Epoxy-Based Processing Agent———

The epoxy-based processing agent is not particularly limited and may be appropriately selected depending on the intended purpose. Examples thereof include a bisphenol A epoxy resin, a bisphenol F epoxy resin, a phenol novolac epoxy resin, a cresol novolac epoxy resin, a bisphenol A novolac epoxy resin, a biphenol epoxy resin, a glycidylamine epoxy resin, and an alicyclic epoxy resin.

As presented by Formula (B) below, the epoxy-based processing agent makes the silica primary particles chemically bonded to one another to form secondary aggregates. In the case where the silica primary particles are processed using the epoxy-based processing agent, a silanol group bonded to the silica primary particle is added to an oxygen atom of an epoxy group of the epoxy-based processing agent or a carbon atom bonded to the epoxy group to form a new Si—O—C bond, to thereby cause second aggregation.

Formula (B)

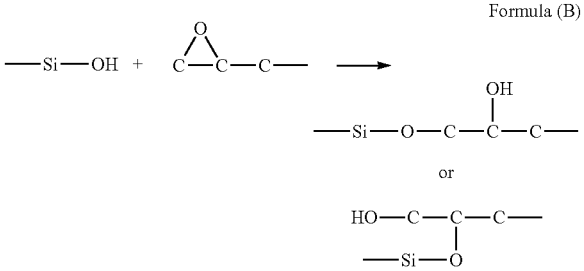

A mixing mass ratio (primary particles: processing agent) between the processing agent and the primary particles is not particularly limited and may be appropriately selected depending on the intended purpose. The mixing mass ratio is preferably from 100:0.01 through 100:50. Note that, the degree of cohesion tends to be high as an amount of the processing agent increases.

A method for mixing the processing agent and the primary particles is not particularly limited and may be appropriately selected depending on the intended purpose. Examples thereof include a method for mixing using a conventional mixer (e.g., a spray dryer). At the time of the mixing, the processing agent may be mixed after preparing the primary particles, or the processing agent is allowed to be present when the primary particles are prepared to thereby prepare a mixture with a one-step reaction.

A firing temperature of the processing agent and the primary particles is not particularly limited and may be appropriately selected depending on the intended purpose. The firing temperature is preferably 100° C. or higher but 2,500° C. or lower. Note that, the degree of cohesion tends to be high as the firing temperature increases.

A firing duration of the processing agent and the primary particles is not particularly limited and may be appropriately selected depending on the intended purpose. The firing duration is preferably 0.5 hours or longer but 30 hours or shorter.

An amount of the external additive is not particularly limited and may be appropriately selected depending on the intended purpose. The amount of the external additive is preferably 0.5 parts by mass or greater but 4.0 parts by mass or less, and more preferably 1.0 part by mass or greater but 4.0 parts by mass or less, relative to 100 parts by mass of the toner base particles. When the amount thereof is 0.5 parts by mass or greater, the coverage of the external additive to the base particle becomes high, and therefore flowability, heat resistant storage stability, durability, and cleaning properties are excellent. When the amount thereof is 4.0 parts by mass or less, the amount of liberated silica on a photoconductor can be kept low, and therefore formation of abnormal images can be prevented.

<<Other Components>>

Examples of other components of the external additive include primary particles.

The primary particles are not particularly limited and may be appropriately selected depending on the intended purpose. Examples of the primary particles include: inorganic particles, such as silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and, silicon nitride; and organic particles. The above-listed examples may be used alone or in combination.

<Toner Base Particles>

The toner base particles include a binder resin and a colorant, preferably includes a release agent, and may further include other ingredients according to the necessity.

<<Binder Resin>>

The toner base particles include a binder resin.

Examples of the binder resin include a polyester resin.

Examples of the polyester resin include an amorphous polyester resin, and a crystalline polyester resin.

The binder resin preferably includes an amorphous polyester resin, and more preferably further includes a crystalline polyester resin.

The amorphous polyester resin is preferably a non-linear amorphous polyester resin.

When the toner base particles include a component insoluble to tetrahydrofuran (THF), the component insoluble to THF preferably includes non-linear amorphous polyester or crystalline polyester.

<<<Amorphous Polyester Resin>>>

The amorphous polyester resin is obtained using a polyvalent alcohol component, and a polyvalent carboxylic acid component, such as polyvalent carboxylic acid, polyvalent carboxylic acid anhydride, and polyvalent carboxylic acid ester.

As described above, the amorphous polyester resin means a resin obtained using a polyvalent alcohol component, and a polyvalent carboxylic acid component, such as polyvalent carboxylic acid, polyvalent carboxylic acid anhydride, and polyvalent carboxylic acid ester, and does not include, for example, a modified polyester resin, such as a below-described prepolymer and a resin obtained through a cross-linking and/or elongation reaction of the prepolymer.

—Polyvalent Alcohol Component—

The polyvalent alcohol component is not particularly limited and may be appropriately selected depending on the intended purpose. Examples of the polyvalent alcohol component include: alkylene (the number of carbon atoms: from 2 through 3) oxide adducts (the average number of moles added: from 1 through 10) of bisphenol A, such as polyoxypropylene(2.2)-2,2-bis(4-hydroxyphenyl)propane, and polyoxyethylene(2.2)-2,2-bis(4-hydroxyphenyl)propane; ethylene glycol, propylene glycol; neopentyl glycol; glycerin; pentaerythritol; trimethylolpropane; hydrogenated bisphenol A; sorbitol; and alkylene (the number of carbon atoms: from 2 through 3) oxide adducts (the average number of moles added: from 1 through 10) thereof. The above-listed examples may be used alone or in combination.

—Polyvalent Carboxylic Acid Component—

The polyvalent carboxylic acid component is not particularly limited and may be appropriately selected depending on the intended purpose. Examples of the polyvalent carboxylic acid component include dicarboxylic acid, succinic acid substituted with an alkyl group having from 1 to 20 carbon atoms or an alkenyl group having from 2 through 20 carbon atoms, trimellitic acid, pyromellitic acid, anhydrides thereof, and alkyl (the number of carbon atoms: from 1 through 8) esters thereof.

Examples of the dicarboxylic acid include adipic acid, phthalic acid, isophthalic acid, terephthalic acid, fumaric acid, and maleic acid.

Examples of the succinic acid substituted with an alkyl group having from 1 to 20 carbon atoms or an alkenyl group having from 2 through 20 carbon atoms include dodecenyl succinic acid, and octyl succinic acid. The above-listed examples may be used alone or in combination.

The amorphous polyester resin and the below-mentioned prepolymer or resin obtained through a cross-linking reaction and/or elongation reaction of the prepolymer are preferably compatible to each other at least at part thereof. Since the amorphous polyester resin and the prepolymer or resin are compatible to each other, low-temperature fixing ability and hot offset resistance can be improved. Therefore, it is preferable that the polyvalent alcohol component and polyvalent carboxylic acid component constituting the amorphous polyester resin have similar compositions to compositions of the polyvalent alcohol component and polyvalent carboxylic acid component constituting the below-mentioned prepolymer.

For example, a molecular structure of the amorphous polyester resin can be confirmed by solution or solid NMR spectroscopy, X-ray diffraction spectroscopy, GC/MS, LC/MS, or IR spectroscopy. As for a simple method thereof, there is a method where a compound giving an infrared absorption spectrum having no absorption based on $\delta_{CH}$ (out plane bending) of olefin at 965±10 $cm^{-1}$ and 990±10 $cm^{-1}$ is detected as an amorphous polyester resin.

A molecular weight of the amorphous polyester resin is not particularly limited and may be appropriately selected depending on the intended purpose. As the molecular weight of the amorphous polyester resin as measured by GPC, the weight average molecular weight (Mw) thereof is preferably 2,500 or greater but 10,000 or less, the number average molecular weight (Mn) thereof is preferably 1,000 or greater but 4,000 or less, and the ratio (Mw/Mn) of the weight average molecular weight to the number average molecular weight is preferably 1.0 or greater but 4.0 or less.

When the weight average molecular weight (Mw) of the amorphous polyester resin is 2,500 or greater and the number average molecular weight (Mn) thereof is 1,000 or greater, heat resistant storage stability of the toner, and durability against stress, such as stirring inside a developing device are improved.

When the weight average molecular weight (Mw) of the amorphous polyester resin is 10,000 or less and the number average molecular weight (Mn) thereof is 4,000 or less, an increase in viscoelasticity of the toner at the time of being melted is prevented and low-temperature fixing ability improves.

An acid value of the amorphous polyester resin is not particularly limited and may be appropriately selected depending on the intended purpose. The acid value thereof is preferably 1 mgKOH/g or greater but 50 mgKOH/g or less, and more preferably 5 mgKOH/g or greater but 30 mgKOH/g or less.

When the acid value is 1 mgKOH/g or greater, a resultant toner tends to be negatively charged, which improves compatibility between the toner and paper at the time of fixing the toner to the paper, and therefore low-temperature fixing ability can be improved.

When the acid value is 50 mgKOH/g or less, charge stability, particularly charge stability against environmental changes, can be maintained.

A hydroxyl value of the amorphous polyester resin is not particularly limited and may be appropriately selected depending on the intended purpose. The hydroxyl value thereof is preferably 5 mgKOH/g or greater.

A glass transition temperature (Tg) of the amorphous polyester resin is not particularly limited and may be appropriately selected depending on the intended purpose. The glass transition temperature (Tg) thereof is preferably 40° C. or higher but 70° C. or lower, and more preferably 45° C. or higher but 60° C. or lower.

When Tg is 40° C. or higher, a resultant toner has excellent heat resistant storage stability, and excellent durability against stress, such as stirring inside a developing device. When Tg is 70° C. or lower, an increase in viscoelasticity of the toner at the time being melted is prevented and excellent low-temperature fixing ability is obtained.

An amount of the amorphous polyester resin is not particularly limited and may be appropriately selected depending on the intended purpose. The amount of the amorphous polyester resin is preferably 50 parts by mass or greater but 95 parts by mass or less, and more preferably 60 parts by mass or greater but 90 parts by mass or less, relative to 100 parts by mass of the toner.

When the amount thereof is 50 parts by mass or greater, dispersibility of a pigment and a release agent in the toner is improved, and therefore fogging or disturbance of an image can be prevented. When the amount thereof is 95 parts by mass or less, the amount of the crystalline polyester is not too small and therefore low-temperature fixing ability can be maintained. When the amount thereof is 60 parts by mass or greater but 90 parts by mass or less, it is advantageous because all of a high image quality, high stability, and low-temperature fixing ability are excellent.

<<<Crystalline Polyester Resin>>>

The crystalline polyester resin has a constitutional unit derived from a saturated aliphatic diol.

As the saturated aliphatic diol, an alcohol component including straight-chain aliphatic diol having from 2 through 8 carbon atoms is preferably used. Use of such an alcohol component can uniformly finely disperse the crystalline polyester resin inside toner particles. Therefore, filming of the crystalline polyester resin is prevented, stress resistance is improved, and excellent low-temperature fixing ability of the toner can be obtained.

Since the crystalline polyester resin has high crystallinity, heat melt properties exhibiting a sharp drop in viscosity at around a fixing onset temperature. Since the crystalline polyester resin having the above-mentioned properties is used in the toner, heat resistance storage stability is excellent owing to crystallinity of the crystalline polyester resin up to just below a melt onset temperature, and a sharp drop in viscosity (sharp melt) is caused at a melt onset temperature to perform fixing. Therefore, a toner having both excellent heat resistant storage stability and low-temperature fixing ability can be obtained. Moreover, the toner has an excellent result of a release width (a difference between the minimum fixing temperature and hot offset generating temperature).

The crystalline polyester resin is obtained by using a polyvalent alcohol component and a polyvalent carboxylic acid component, such as polyvalent carboxylic acid, polyvalent carboxylic acid anhydride, and polyvalent carboxylic acid ester.

As described above, the crystalline polyester resin is a resin obtained from a polyvalent alcohol component and a polyvalent carboxylic acid component, such as polyvalent carboxylic acid, polyvalent carboxylic acid anhydride, and polyvalent carboxylic acid ester. For example, a modified crystalline polyester resin, such as the below-mentioned prepolymer and a resin obtained through a cross-linking reaction and/or elongation reaction of the prepolymer, does not belong to the crystalline polyester resin.

—Polyvalent Alcohol Component—

The polyvalent alcohol component is not particularly limited and may be appropriately selected depending on the intended purpose. Examples of the polyvalent alcohol component include diol, and trivalent or higher alcohol.

Examples of the diol include saturated aliphatic diol.

Examples of the saturated aliphatic diol include straight-chain saturated aliphatic diol and branched saturated aliphatic diol. Among the above-listed examples, straight-chain saturated aliphatic diol is preferable, and straight-chain saturated aliphatic diol having 2 or greater but 8 or less carbon atoms is more preferable.

When the saturated aliphatic diol is straight-chain saturated aliphatic diol, a resultant crystalline polyester resin has high crystallinity and high melting point. When the number of carbon atoms in the principle chain site is 2 or greater, a melting point is prevented from being too high, and excellent low-temperature fixing ability is obtained when the saturated aliphatic diol is polymerized through condensation polymerization through aromatic dicarboxylic acid. When the number of carbon atoms in the principle chain site is 8 or less, materials are readily available on practical use.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. The above-listed examples may be used alone or in combination. Among the above-listed examples, ethylene glycol, 1,3-propanediol, 1,4-butanediol, 1,5-pentanediol, and 1,6-hexanediol are preferable because of high crystallinity and excellent sharp melt properties of the crystalline polyester resin.

Examples of the trivalent or higher alcohol include glycerin, trimethylolethane, trimethylolpropane, and pentaerythritol. The above-listed examples may be used alone or in combination.

—Polyvalent Carboxylic Acid Component—

The polyvalent carboxylic acid component is preferably sebacic acid. Moreover, other divalent carboxylic acids and trivalent or higher carboxylic acids may be used in combination according to the necessity.

Examples of the trivalent carboxylic acid include saturated aliphatic dicarboxylic acid, and aromatic dicarboxylic acid (e.g., dibasic acid).

Examples of the saturated aliphatic dicarboxylic acid include oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid.

Examples of the aromatic dicarboxylic acid (e.g., dibasic acid) include phthalic acid, isophthalic acid, terephthalic acid, naphthalene-2,6-dicarboxylic acid, malonic acid, and mesaconic acid.

Examples thereof further include anhydrides and lower alkyl esters of the above-listed carboxylic acids.

Examples of the trivalent or higher carboxylic acid include 1,2,4-benzenetricarboxylic acid, 1,2,5-benzenetricarboxylic acid, 1,2,4-naphthalenetricarboxylic acid, anhydrides thereof, and lower alkyl esters thereof.

The polyvalent carboxylic acid component may include, in addition to the saturated aliphatic dicarboxylic acid and the aromatic dicarboxylic acid, a dicarboxylic acid component having a sulfonic acid group. In addition to the saturated aliphatic dicarboxylic acid and the aromatic dicarboxylic acid, the polyvalent carboxylic acid component may further include a dicarboxylic acid component having a double bond. The above-listed examples may be used alone or in combination.

For example, a molecular structure of the crystalline polyester resin can be confirmed by solution or solid NMR spectroscopy, X-ray diffraction spectroscopy, GC/MS, LC/MS, or IR spectroscopy. As a simple method thereof, there is a method where a compound giving an infrared absorption spectrum having no absorption based on $\delta_{CH}$ (out plane bending) of olefin at 965±10 $cm^{-1}$ and 990±10 $cm^{-1}$ is detected as an amorphous polyester resin.

A melting point of the crystalline polyester resin is not particularly limited and may be appropriately selected depending on the intended purpose. The melting point thereof is preferably 60° C. or higher but lower than 80° C. When the melting point is 60° C. or higher, the crystalline polyester resin is prevented from being melted at a low temperature, and heat resistant storage stability of a resultant toner can be improved. When the melting point is lower than 80° C., low-temperature fixing ability can be improved.

For example, the melting point can be determined from an endothermic peak value of a DSC chart in differential scanning calorimetry (DSC).

A molecular weight of the crystalline polyester resin is not particularly limited and may be appropriately selected depending on the intended purpose. In GPC, a weight average molecular weight (Mw) of the crystalline polyester resin is preferably 3,000 or greater but 30,000 or less, a number average molecular weight (Mn) of the crystalline polyester resin is preferably 1,000 or greater but 10,000 or less, and a ratio (Mw/Mn) of the weight average molecular weight thereof to the number average molecular weight thereof is preferably 1.0 or greater but 10 or less.

Note that, in the case where the crystalline polyester resin is dissolved in orthodichlorobenzene, a molecular weight of the crystalline polyester resin is a molecular weight of the soluble component of the crystalline polyester resin to orthodichlorobenzene.

In GPC, an amount of the crystalline polyester having the number average molecular weight (Mn) of 1,000 or less is preferably 10% or less in view of low-temperature fixing ability and heat resistant storage stability.

An acid value of the crystalline polyester resin is not particularly limited and may be appropriately selected depending on the intended purpose. The acid value thereof is preferably 5 mgKOH/g or greater but 45 mgKOH/g or less, and more preferably 10 mgKOH/g or greater but 45 mgKOH/g or less.

When the acid value is 5 mgKOH/g or greater, excellent affinity between a recording medium, such as paper, and the resin, and excellent low-temperature fixing ability are obtained. When the acid value is 45 mgKOH/g or less, hot offset resistance can be improved.

A hydroxyl value of the crystalline polyester resin is not particularly limited and may be appropriately selected depending on the intended purpose. In view of low-temperature fixing ability and charging ability, the hydroxyl value thereof is preferably 50 mgKOH/g or less, and more preferably 5 mgKOH/g or greater but 50 mgKOH/g or less.

An amount of the crystalline polyester resin is not particularly limited and may be appropriately selected depending on the intended purpose. The amount of the crystalline polyester resin is preferably 2 parts by mass or greater but 20 parts by mass or less, and more preferably 5 parts by mass or greater but 15 parts by mass or less, relative to 100 parts by mass of the toner.

When the amount of the crystalline polyester resin is 2 parts by mass or greater, excellent sharp-melt properties of the crystalline polyester resin and excellent low-temperature fixing ability are obtained. When the amount thereof is 20 parts by mass or less, excellent heat resistant storage stability is obtained and image fogging can be prevented. Use of the crystalline polyester resin in the amount of 5 parts by mass or greater but 15 parts by mass or less is advantageous because all of image quality, stability, and low-temperature fixing ability are excellent.

<<Colorant>>

The toner base particles include a colorant.

The colorant is not particularly limited and may be appropriately selected depending on the intended purpose. Examples of the colorant include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, red iron oxide, red lead, lead vermilion, cadmium red, cadmium mercury red, antimony vermilion, permanent red 4R, para-red, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. The above-listed examples may be used alone or in combination.

An amount of the colorant is not particularly limited and may be appropriately selected depending on the intended purpose. The amount thereof is preferably 1 part by mass or greater but 15 parts by mass or less, and more preferably 3 parts by mass or greater but 10 parts by mass or less, relative to 100 parts by mass of the toner.

The colorant may be also used as a master batch in which the colorant forms a composite with a resin.

The resin used for the production of the master batch or the resin kneaded together with the master batch is not particularly limited and may be appropriately selected depending on the intended purpose. Examples of the resin include, in addition to a hybrid resin: polymers of styrene or substituted styrene, such as polystyrene, poly(p-chlorostyrene), and polyvinyl toluene; styrene-based copolymers, such as styrene-p-chlorostyrene copolymer, styrene-propylene copolymer, styrene-vinyltoluene copolymer, styrene-vinylnaphthalene copolymer, styrene-methacrylate copolymer, styrene-ethylacrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-malleic acid ester copolymer; polymethyl methacrylate; polybutyl methacrylate; polyvinyl chloride; polyvinyl acetate; polyethylene; polypropylene; polyester; an epoxy resin; an epoxypolyol resin; polyurethane; polyamide; polyvinyl butyral; polyacrylic resin; rosin; modified rosin; a terpene resin; aliphatic or alicyclic hydrocarbon resin; an aromatic petroleum resin; chlorinated paraffin; and paraffin wax. The above-listed examples may be used alone or in combination.

The master batch can be obtained by applying high shear force to a resin for a master batch and a colorant to mix and kneading the mixture. In order to enhance interaction between the colorant and the resin, an organic solvent can be used. Moreover, a so-called flashing method is preferably used, since a wet cake of the colorant can be directly used without being dried. The flashing method is a method in which an aqueous paste containing a colorant is mixed or kneaded with a resin and an organic solvent, and then the colorant is transferred to the resin to remove the moisture and the organic solvent. As for the mixing and kneading, a high-shearing disperser (e.g., a three-roll mill) is preferably used.

<<Release Agent>>

The toner base particles preferably include a release agent.

The release agent is not particularly limited and may be appropriately selected depending on the intended purpose. Examples of the release agent include wax release agents.

Examples of the wax release agents include natural wax and synthetic wax.

Examples of the natural wax include vegetable wax, animal wax, mineral wax, and petroleum wax.

Examples of the vegetable wax include carnauba wax, cotton wax, Japanese wax, and rice bran wax.

Examples of the animal wax include bees wax, and lanolin.

Examples of the mineral wax include ozocerite, and ceresin.

Examples of the petroleum wax include paraffin wax, microcrystalline wax, and petrolatum wax.

Among the above-listed examples, paraffin wax and microcrystalline wax are preferable.

Examples of the synthesis wax include synthetic hydrocarbon wax, and wax including ester, ketone, ether, etc.

Examples of the synthetic hydrocarbon wax include Fischer-Tropsch wax, polyethylene wax, and polypropylene wax.

Examples of other synthesis wax include fatty acid amide-based compounds, homopolymers or copolymers of polyacrylate, and crystalline polymers having a long alkyl group at a side chain thereof.

Examples of the fatty acid amine-based compounds include 12-hydroxystearic acid amide, stearic acid amide, phthalimide anhydride, and chlorinated hydrocarbon.

Examples of the homopolymers or copolymers of polyacrylate include low-molecular weight crystalline polymer resins, such as poly(n-stearyl methacrylate), and poly(n-lauryl methacrylate). Specific examples thereof include a n-stearyl acrylate-ethyl methacrylate copolymer. The above-listed examples may be used alone or in combination.

Among the above-listed examples, synthetic hydrocarbon wax is preferable.

The release agent is preferably hydrocarbon-based wax having a melting point of 60° C. or higher but lower than 95° C. The synthetic hydrocarbon wax having a melting point of 60° C. or higher but lower than 95° C. can effectively function as a release agent an interface between a fixing roller and the toner. Therefore, hot offset resistance can be improved without applying a release agent, such as oil, to a fixing roller.

Particularly, the synthetic hydrocarbon wax is preferable because the synthetic hydrocarbon wax is hardly compatible with the polyester resin, and the synthetic hydrocarbon wax and the polyester resin each independently function, and therefore a softening effect of the crystalline polyester resin as a binder resin and offset properties of a release agent are rarely impaired.

A melting point of the release agent is not particularly limited and may be appropriately selected depending on the intended purpose. The melting point thereof is preferably 60° C. or higher but lower than 95° C. When the melting point of the release agent is 60° C. or higher, the release agent is prevented from being melted at a low temperature, and heat resistant storage stability of a resultant toner can be improved. When the melting point of the release agent is lower than 95° C., the release agent is easily melted by heat applied at the time of fixing, and sufficient offset properties can be obtained.

An amount of the release agent is not particularly limited and may be appropriately selected depending on the intended purpose. The amount thereof is preferably 2 parts by mass or greater but 10 parts by mass or less, and more preferably 3 parts by mass or greater but 8 parts by mass or less, relative to 100 parts by mass of the toner.

When the amount of the release agent is 2 parts by mass or greater, excellent hot offset resistance at the time of fixing and excellent low-temperature fixing ability can be obtained. When the amount thereof is 10 parts by mass or less, heat resistant storage stability is improved and image fogging can be prevented. Use of the release agent in the amount of 3 parts by mass or greater but 8 parts by mass or less is advantageous because image quality and fixing stability can be improved.

<<Other Ingredients>>

Other components in the toner base particles are is not particularly limited and may be appropriately selected depending on the intended purpose. Examples thereof include a polymer having a site reactive with an active hydrogen group-containing compound, an active hydrogen group-containing compound, a charge controlling agent, a magnetic material, a cleaning improving agent, and a flowability improving agent.

—Polymer Having Site Reactive with Active Hydrogen Group-Containing Compound—

The polymer having a site reactive with an active hydrogen group-containing compound (may be referred to as a "prepolymer") is not particularly limited and may be appropriately selected depending on the intended purpose. Examples thereof include a polyol resin, a polyacrylic resin, a polyester resin, an epoxy resin, and derivatives thereof. The above-listed examples may be used alone or in combination.

Among the above-listed examples, a polyester resin is preferable in view of high fluidity when being melted and transparency.

Examples of the site included in the prepolymer and reactive with the active hydrogen group-containing compound include an isocyanate group, an epoxy group, a carboxyl group, and a functional group represented by —COCl. The above-listed examples may be used alone or in combination.

Among the above-listed examples, an isocyanate group is preferable.

The prepolymer is not particularly limited and may be appropriately selected depending on the intended purpose. The prepolymer is preferably a polyester resin including an isocyanate group capable of generating a urea bond because a molecular weight of a polymer component is easily adjusted, oil-less low-temperature fixing ability is obtained with a dry toner, and excellent releasability and fixing ability can be secured particularly when a release oil application system to a heating medium for fixing is not present.

—Active Hydrogen Group-Containing Compound—

The active hydrogen group-containing compound functions as an elongation agent, a cross-linking agent, etc., when the polymer having a site reactive with the active hydrogen group-containing compound causes an elongation reaction, a cross-linking reaction, etc., in an aqueous medium.

The active hydrogen group is not particularly limited and may be appropriately selected depending on the intended purpose. Examples of the active hydrogen group include a hydroxyl group (alcoholic hydroxyl group and a phenolic hydroxyl group), an amino group, a carboxyl group, and a mercapto group. The above-listed examples may be used alone or in combination.

The active hydrogen group-containing compound is not particularly limited and may be appropriately selected depending on the intended purpose. When the polymer having a site reactive with the active hydrogen group-containing compound is a polyester resin including an isocyanate group, the active hydrogen group-containing compound is preferably amines because a molecular weight of a resultant polymer can be increased by an elongation reaction, a cross-linking reaction, etc., with the polyester resin.

The amines are not particularly limited and may be appropriately selected depending on the intended purpose. Examples of the amines include diamine, trivalent or higher amine, amino alcohol, aminomercaptan, amino acids, and products obtained by blocking an amino group of the above-listed amines. The above-listed examples may be used alone or in combination.

Among the above-listed examples, diamine, and a mixture of diamine and a small amount of trivalent or higher amine are preferable.

The diamine is not particularly limited and may be appropriately selected depending on the intended purpose. Examples thereof include aromatic diamine, alicyclic diamine, and aliphatic diamine.

The aromatic diamine is not particularly limited and may be appropriately selected depending on the intended purpose. Examples of the aromatic diamine include phenylene diamine, diethyl toluene diamine, and 4,4'-diaminodiphenylmethane.

The alicyclic diamine is not particularly limited and may be appropriately selected depending on the intended purpose. Examples of the alicyclic diamine include 4,4'-diamino-3,3'-dimethyldicyclohexylmethane, diaminocyclohexane, and isophoronediamine.

The aliphatic diamine is not particularly limited and may be appropriately selected depending on the intended purpose. Examples of the aliphatic diamine include ethylene diamine, tetramethylene diamine, and hexamethylene diamine.

The trivalent or higher amine is not particularly limited and may be appropriately selected depending on the intended purpose. Examples of the trivalent or higher amine include diethylene triamine, and triethylene tetramine.

The amino alcohol is not particularly limited and may be appropriately selected depending on the intended purpose. Examples of the amino alcohol include ethanolamine, and hydroxyethylaniline.

The aminomercaptan is not particularly limited and may be appropriately selected depending on the intended purpose. Examples thereof include aminoethylmercaptan and aminopropylmercaptan.

The amino acid is not particularly limited and may be appropriately selected depending on the intended purpose. Examples of the amino acid include amino propionic acid, and amino caproic acid.

Examples of the product obtained by blocking the amino group is not particularly limited and may be appropriately selected depending on the intended purpose. Examples thereof include a ketimine compound and oxazolidine compound each obtained by blocking the amino group with ketones, such as acetone, methyl ethyl ketone, and methyl isobutyl ketone.

The polyester resin including the isocyanate group (may be also referred to as a "polyester prepolymer including an isocyanate group" hereinafter) is not particularly limited and may be appropriately selected depending on the intended purpose. Examples thereof include a reaction product of a polyester resin including an active hydrogen group obtained through polycondensation between polyol and polycarboxylic acid, and polyisocyanate.

The polyol is not particularly limited and may be appropriately selected depending on the intended purpose. Examples of the polyol include diol, trivalent or higher alcohol, and a mixture of diol and trivalent or higher alcohol. The above-listed examples may be used alone or in combination.

Among the above-listed example, preferred are diol, and a mixture of diol and a small amount of trivalent or higher alcohol.

The diol is not particularly limited and may be appropriately selected depending on the intended purpose. Examples of the diol include: alkylene glycol, such as ethylene glycol, 1,2-propyleneglycol, 1,3-propyleneglycol, 1,4-butanediol, and 1,6-hexanediol; diol including an oxyalkylene group, such as diethylene glycol, triethylene glycol, dipropyleneglycol, polyethylene glycol, polypropylene glycol, and polytetramethylene glycol; alicyclic diol, such as 1,4-cyclohexanedimethanol, and hydrogenated bisphenol A; adducts of alicyclic diol with alkylene oxide (e.g., ethylene oxide, propylene oxide, and butylene oxide; bisphenols, such as bisphenol A, bisphenol F, and bisphenol S; and alkylene oxide adducts of bisphenols, such as adducts of bisphenols with alkylene oxide (e.g., ethylene oxide, propylene oxide, and butylene oxide).

The number of carbon atoms of the alkylene glycol is not particularly limited and may be appropriately selected depending on the intended purpose. The number thereof is preferably from 2 through 12.

Among the above-listed examples, alkylene glycol having from 2 through 12 carbon atoms, and alkylene oxide addicts of bisphenols are preferable, alkylene oxide adducts of bisphenols, and a mixture of an alkylene oxide adduct of bisphenol and alkylene glycol having from 2 through 12 carbon atoms are more preferable.

The trivalent or higher alcohol is not particularly limited and may be appropriately selected depending on the intended purpose. Examples of the trivalent or higher alcohol include trivalent or higher aliphatic alcohol, trivalent or higher polyphenols, and alkylene oxide adducts of trivalent or higher polyphenols.

The trivalent or higher alcohol is not particularly limited and may be appropriately selected depending on the intended purpose. Examples thereof include glycerin, trimethylol ethane, trimethylol propane, pentaerythritol, and sorbitol.

The trivalent or higher polyphenols is not particularly limited and may be appropriately selected depending on the intended purpose. Examples thereof include trisphenol PA, phenol novolac, and cresol novolac.

Examples of the alkylene oxide adduct of the trivalent or higher polyphenols include an adduct of trivalent or higher polyphenols with alkylene oxide (e.g., ethyleneoxide, propyleneoxide, and butylene oxide.

In the case where the diol and the trivalent or higher alcohol are mixed, a mass ratio of the trivalent or higher alcohol relative to the diol is preferably 0.01% by mass or greater but 10% by mass or less, and more preferably 0.01% by mass or greater but 1% by mass or less.

The polycarboxylic acid is not particularly limited and may be appropriately selected depending on the intended purpose. Examples of the polycarboxylic acid include dicarboxylic acid, trivalent or higher carboxylic acid, and a mixture of dicarboxylic acid and trivalent or higher carboxylic acid. The above-listed examples may be used alone or in combination.

Among the above-listed examples, dicarboxylic acid, and a mixture of dicarboxylic acid and a small amount of trivalent or higher polycarboxylic acid are preferable.

The dicarboxylic acid is not particularly limited and may be appropriately selected depending on the intended purpose. Examples of the dicarboxylic acid include divalent alkanoic acid, divalent alkenoic acid, and aromatic dicarboxylic acid.

The divalent alkanoic acid is not particularly limited and may be appropriately selected depending on the intended purpose. Examples thereof include succinic acid, adipic acid, and sebacic acid.

The divalent alkenoic acid is not particularly limited and may be appropriately selected depending on the intended purpose. The divalent alkenoic acid is preferably divalent alkenoic acid having from 4 through 20 carbon atoms. The divalent alkenoic acid having from 4 through 20 carbon atoms is not particularly limited and may be appropriately selected depending on the intended purpose. Examples thereof include maleic acid and fumaric acid.

The aromatic dicarboxylic acid is not particularly limited and may be appropriately selected depending on the intended purpose. The aromatic dicarboxylic acid is preferably aromatic dicarboxylic acid having from 8 through 20 carbon atoms. The aromatic dicarboxylic acid having from 8 through 20 carbon atoms is not particularly limited and may be appropriately selected depending on the intended purpose. Examples thereof include phthalic acid, isophthalic acid, terephthalic acid, and naphthalene dicarboxylic acid.

The trivalent or higher carboxylic acid is not particularly limited and may be appropriately selected depending on the intended purpose. Examples thereof include trivalent or higher aromatic carboxylic acid.

The trivalent or higher aromatic carboxylic acid is not particularly limited and may be appropriately selected depending on the intended purpose. The trivalent or higher aromatic carboxylic acid is preferably trivalent or higher aromatic carboxylic acid having from 9 through 20 carbon atoms. The trivalent or higher aromatic carboxylic acid having from 9 through 20 carbon atoms is not particularly limited and may be appropriately selected depending on the intended purpose. Examples thereof include trimellitic acid and pyromellitic acid.

As the polycarboxylic acid, acid anhydride or lower alkyl ester of dicarboxylic acid, or trivalent or higher carboxylic acid, or a mixture of dicarboxylic acid and trivalent or higher carboxylic acid may be also used.

The lower alkyl ester is not particularly limited and may be appropriately selected depending on the intended purpose. Examples thereof include methyl ester, ethyl ester, and isopropyl ester.

When a mixture of the dicarboxylic acid and the trivalent or higher carboxylic acid is used, a mass ratio of the trivalent or higher carboxylic acid to the dicarboxylic acid is not particularly limited and may be appropriately selected depending on the intended purpose. The mass ratio is preferably 0.01% by mass or greater but 10% by mass or less, and more preferably 0.01% by mass or greater but 1% by mass or less.

When polycondensation of the polyol and the polycarboxylic acid is performed, an equivalent ratio of hydrogen groups of the polyol to carboxyl groups of the polycarboxylic acid is not particularly limited and may be appropriately selected depending on the intended purpose. The equivalent ratio thereof is preferably 1 or greater but 2 or less, more preferably 1 or greater but 1.5 or less, and particularly preferably 1.02 or greater but 1.3 or less.

An amount of a constitutional unit derived from polyol in the polyester prepolymer including an isocyanate group is not particularly limited and may be appropriately selected depending on the intended purpose. The amount thereof is preferably 0.5% by mass or greater but 40% by mass or less, more preferably 1% by mass or greater but 30% by mass or less, and particularly preferably 2% by mass or greater but 20% by mass or less.

When the amount thereof is 0.5% by mass or greater, hot offset resistance is improved, and both heat storage stability and low-temperature fixing ability of the toner can be obtained. When the amount thereof is 40% by mass or less, low-temperature fixing ability can be improved.

The polyisocyanate is not particularly limited and may be appropriately selected depending on the intended purpose. Examples thereof include aliphatic diisocyanate, alicyclic diisocyanate, aromatic diisocyanate, aromatic aliphatic diisocyanate, isocyanurate, phenol derivative thereof, and products obtained by blocking the above-listed polyisocyanates with oxime, or caprolactam.

The aliphatic diisocyanate is not particularly limited and may be appropriately selected depending on the intended purpose. Examples of the aliphatic diisocyanate include tetramethylene diixocyanate, hexamethylene diisocyanate, 2,6-diisocyanatocaproic acid methyl ester, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be appropriately selected depending on the intended purpose. Examples thereof include isophorone diisocyanate, and cyclohexylmethane diisocyanate.

The aromatic diisocyanate is not particularly limited and may be appropriately selected depending on the intended purpose. Examples thereof include tolylene diisocyanate, diisocyanatodiphenyl methane, 1,5-naphthylenediisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

The aromatic aliphatic diisocyanate is not particularly limited and may be appropriately selected depending on the intended purpose. Examples of the aromatic aliphatic diisocyanate include α,α,α',α'-tetramethylxylenediisocyanate.

The isocyanurate is not particularly limited and may be appropriately selected depending on the intended purpose. Examples thereof include tris(isocyanatalkyl)isocyanurate, and tris(isocyanatocycloalkyl)isocyanurate. The above-listed examples may be used alone or in combination.

When the polyisocyanate and the polyester resin including a hydroxyl group are reacted, an equivalent ratio of isocyanate groups of the polyisocyanate to hydroxyl groups of the polyester resin is not particularly limited and may be appropriately selected depending on the intended purpose. The equivalent ratio thereof is preferably 1 or greater but 5 or less, more preferably 1.2 or greater but 4 or less, and particularly preferably 1.5 or greater but 3 or less. When the equivalent ratio is 1 or greater, offset resistance is improved. When the equivalent ratio is 5 or less, low-temperature fixing ability is improved.

An amount of a constitutional unit derived from polyisocyanate in the polyester prepolymer including an isocyanate group is not particularly limited and may be appropriately selected depending on the intended purpose. The amount thereof is preferably 0.5% by mass or greater but 40% by mass or less, more preferably 1% by mass or greater but 30% by mass or less, and particularly preferably 2% by mass or greater but 20% by mass or less. When the amount thereof is 0.5% by mass or greater, hot offset resistance is improved. When the amount thereof is 40% by mass or less, low-temperature fixing ability is improved.

The average number of isocyanate groups per molecule of the polyester prepolymer including an isocyanate group is not particularly limited and may be appropriately selected depending on the intended purpose. The average number thereof is preferably 1 or greater, more preferably 1.2 or greater but 5 or less, and particularly preferably 1.5 or greater but 4 or less. When the average number thereof is 1 or greater, a molecular weight of a urea-modified polyester-based resin is not too small, and hot offset resistance is improved.

A mass ratio of the polyester prepolymer including an isocyanate group to a polyester resin including 50 mol % or greater of a bisphenol propylene oxide adduct in the polyvalent alcohol component and having a certain hydroxyl value and a certain acid value is not particularly limited and may be appropriately selected depending on the intended purpose. The mass ratio thereof is preferably 5/95 or greater but 25/75 or less, and more preferably 10/90 or greater but 25/75 or less. When the mass ratio is 5/95 or greater, hot offset resistance is improved. When the mass ratio is 25/75 or less, low-temperature fixing ability, and glossiness of an image is improved.

—Charge Controlling Agent—

The charge controlling agent is not particularly limited and may be appropriately selected depending on the intended purpose. Examples of the charge controlling agent include a nigrosine-based dye, a triphenylmethane-based dye, a chrome-containing metal complex dye, a molybdic acid chelate pigment, a rhodamine-based dye, an alkoxy-based amine, a quaternary ammonium salt (including fluorine-modified quaternary ammonium, alkylamide, phosphorus or a compound thereof, tungsten or a compound thereof, a fluorosurfactant, a metal salt of salicylic acid, and a metal salt of a salicylic acid derivative. The above-listed examples may be used alone or in combination.

An appropriate commercial product may be used as the charge controlling agent. Examples of the commercial product include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); LRA-901, and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, and quaternary ammonium salt. The above-listed examples may be used alone or in combination.

An amount of the charge controlling agent is not particularly limited and may be appropriately selected depending on the intended purpose. The amount of the charge controlling agent is preferably 0.1 parts by mass or greater but 10 parts by mass or less, and more preferably 0.2 parts by mass or greater but 5 parts by mass or less, relative to 100 parts by mass of the toner. When the amount of the charge controlling agent is 0.1 parts by mass or greater, an excellent effect of the charge controlling agent is obtained. When the amount thereof is 10 parts by mass or less, appropriate charging ability of the toner is obtained, an excellent effect of the charge controlling agent is obtained, and an electrostatic suction force with a developing roller is maintained. Moreover, flowability of the developer is improved, and excellent image density is obtained.

The charge controlling agent may be melt-kneaded with a master batch or resin, followed by dissolving and dispersing in an organic solvent. Alternatively, the charge controlling agent may be directly added when other materials are dissolved and dispersed, or may be deposited and fixed on surfaces of toner base particles, after producing the toner base particles.

—Magnetic Material—

The magnetic material is not particularly limited and may be appropriately selected depending on the intended purpose. Examples thereof include iron powder, magnetite, and ferrite. Among the above-listed examples, white magnetic materials are preferable in view of color tone.

—Cleaning Improving Agent—

The cleaning improving agent is not particularly limited and may be appropriately selected depending on the intended purpose, as long as the cleaning improving agent is an agent added to the toner in order to remove a developer remained on a photoconductor or a primary transfer member after transferring. Examples of the cleaning improving agent include: fatty acid (e.g., stearic acid) metal salts, such as zinc stearate, and calcium stearate; and polymer particles produced by soap-free emulsification polymerization, such as polymethyl methacrylate particles, and polystyrene particles.

The volume average particle diameter of the polymer particles is not particularly limited and may be appropriately selected depending on the intended purpose. The polymer particles are preferably polymer particles having a relatively narrow particle size distribution. The volume average particle diameter thereof is more preferably 0.01 μm or greater but 1 μm or less.

—Flowability Improving Agent—

The flowability improving agent is an agent used to perform a surface treatment to increase hydrophobicity to prevent degradation of flowability and charging properties even in high humidity environment. Examples of the flowability improving agent include a silane coupling agent, a silylation agent, a silane-coupling agent containing a fluoroalkyl group, an organic titanate-based coupling agent, an aluminum-based coupling agent, silicone oil, and modified-silicone oil.

Note that, the flowability improving agent may be subjected to a surface treatment with silica or titanium oxide. In this case, the flowability improving agent is preferably used as hydrophobicity silica, hydrophobicity titanium oxide.

[Physical Properties of Toner]

For example, a hydroxyl value can be measured using a method according to JIS K0070-1966.

Specifically, first, 0.5 g of a sample is weighed in a 100 mL measuring flask, and 5 mL of an acetylation reagent is added to the flask. Next, after heating the resultant mixture for from 1 hour through 2 hours in a hot bath of 100±5° C., the flask is taken out from the hot bath and is allowed to cool. Moreover, water is added to the flask and the mixture is shaken to decompose acetic anhydride. Next, after heating the flask in the hot bath again for 10 minutes or longer and allowing to cool in order to completely decompose acetic anhydride, the wall of the flask is sufficiently washed with an organic solvent.

Furthermore, a hydroxyl value is measured at 23° C. by means of an automatic potentiometric titrator DL-53 Titrator (available from Mettler-Toledo International Inc.) and an electrode DG113-SC (available from Mettler-Toledo International Inc.), and is analysed using analysis software LabX Light Version 1.00.000. Note that, for cariburation of a device, a mixed solvent of 120 mL of toluene and 30 mL of ethanol is used.

The measuring conditions are as follows.

—Measuring Conditions—

```
Stir
    Speed [%] 25
    Time[s] 15
EQP titration
    Titrant/Sensor
        Titrant CH3ONa
        Concentration [mol/L] 0.1
        Sensor   DG115
        Unit of measurement mV
    Predispensing to volume
        Volume [mL] 1.0
        Wait time[s] 0
    Titrant addition   Dynamic
        dE(set) [mV]   8.0
        dV(min) [mL]   0.03
        dV(max) [mL]   0.5
    Measure mode   Equilibrium controlled
        dE [mV]   0.5
        dt [s]   1.0
        t(min) [s]   2.0
        t(max) [s]   20.0
```

-continued

```
Recognition
    Threshold   100.0
    Steepest jump only No
    Range   No
    Tendency   None
Termination
    at maximum volume [mL]   10.0
    at potential   No
    at slope   No
    after number EQPs   Yes
        n = 1
    comb.termination conditions   No
Evaluation
    Procedure   Standard
    Potential 1   No
    Potential 2   No
    Stop for reevaluation   No
```

An acid value of the toner is not particularly limited and may be appropriately selected depending on the intended purpose. The acid value thereof is preferably 0.5 mgKOH/g or greater but 40 mgKOH/g or less in view of controlling low-temperature fixing ability (the minimum fixing temperature) and a hot offset onset temperature.

When the acid value is 0.5 mgKOH/g or greater, dispersion stability is improved owing base at the time of production, and therefore production stability is improved. When the acid value is 40 mgKOH/g or less, an elongation reaction and/or cross-linking reaction is sufficiently progressed when the prepolymer is used, and therefore hot offset resistance is improved.

The acid value can be measured by a method according to JIS K0070-1992.

Specifically, first, 0.5 g of a sample (0.3 g of an ethyl acetate-soluble component) is added to 120 mL of toluene, and the resultant mixture is stirred for about 10 hours at 23° C. to dissolve the sample. Next, 30 mL of ethanol was added to the resultant solution to prepare a sample solution. When the sample is not dissolved, a solvent, such as dioxane, and tetrahydrofuran, is used. Moreover, an acid value is measured at 23° C. by means of an automatic potentiometric titrator DL-53 Titrator (available from Mettler-Toledo International Inc.) and an electrode DG113-SC (available from Mettler-Toledo International Inc.), and analyzed using analysis software LabX Light Version 1.00.000. Note that, a mixed solvent including 120 mL of toluene and 30 mL of ethanol is used for calibration of the device.

The measuring conditions are identical to the above-described conditions for measuring a hydroxyl value.

The acid value can be measured as described above. Specifically, a sample is titrated with a 0.1N potassium hydroxide/alcohol solution, which has been standardized in advance, and the acid value is calculated from the titer using the following formula.

$$\text{Acid value [mgKOH/g]} = \text{titer [mL]} \times N \times 56.1 \text{ [mg/mL]} / \text{sample mass [g]}$$

(with the proviso that N is a factor of the 0.1N potassium hydroxide/alcohol solution).

A glass transition temperature (Tg) of the toner is not particularly limited and may be appropriately selected depending on the intended purpose. A glass transition temperature (Tg1st) thereof calculated at the first heating in the DSC measurement thereof is preferably 45° C. or higher but lower than 65° C., and more preferably 50° C. or higher but 60° C. or lower.

Since the toner has the above-mentioned glass transition temperature, low-temperature fixing ability, heat resistant storage stability, and high durability of the toner can be obtained. When the Tg1st is 45° C. or higher, blocking inside a developing device or filming on a photoconductor can be prevented. When the Tg1st is lower than 65° C., low-temperature fixing ability can be improved.

The glass transition temperature (Tg2nd) calculated with second heating in a DSC measurement of the toner is preferably 20° C. or higher but lower than 40° C. When the Tg2nd is 20° C. or higher, blocking inside a developing device or filming on a photoconductor can be prevented. When the Tg2nd is 40° C. or lower, low-temperature fixing ability can be improved.

For example, the melting point and glass transition temperature (Tg) can be measured by means of a DSC system (differential scanning calorimeter) (DSC-60, available from Shimadzu Corporation).

Specifically, a melting point and a glass transition temperature of a target sample can be measured in the following manner.

First, about 5.0 mg of a target sample is placed in a sample container formed of aluminium, the sample container is placed on a holder unit, and then the holder unit is set in an electric furnace. Subsequently, the sample is heated from 0° C. to 150° C. at heating speed of 10° C./min in a nitrogen atmosphere. Thereafter, the sample is then cooled from 150° C. to 0° C. at cooling speed of 10° C./min, followed by heating to 150° C. at heating speed of 10° C./min, to thereby measure DSC curves using a differential scanning calorimeter (DSC-60, available from Shimadzu Corporation).

A DSC curve of the first heating is selected from the obtained DSC curves using an analysis program "endothermic shoulder temperature" in the DSC-60 system, and a glass transition temperature of the target sample for the first heating can be determined. Moreover, a DSC curve of the second heating is selected using "endothermic shoulder temperature," and a glass transition temperature of the target sample for the second heating can be determined.

Moreover, a DSC curve of the first heating is selected from the obtained DSC curves using an analysis program "endothermic peak temperature" in the DSC-60 system, a melting point of the target sample for the first heating can be determined. Moreover, a DSC curve of the second heating is selected using "endothermic peak temperature," and a melting point of the target sample for the second heating can be determined.

When a toner is used as a target sample, a glass transition temperature of first heating can be determined as Tg1st, and a glass transition temperature of second heating can be determined as Tg2nd.

A melting point and Tg of each constitutional component for second heating can be determined as a melting point and Tg of each target sample.

The volume average particle diameter of the toner is not particularly limited and may be appropriately selected depending on the intended purpose. In view of image quality and a system problem, the volume average particle diameter thereof is preferably 3 μm or greater but 7 μm or less, and more preferably 3 μm or greater but 6 μm or less. When the volume average particle diameter is 3 μm or greater, the toner is easily scraped off with a blade in a cleaning unit, and therefore excellent cleaning properties can be obtained. When the volume average particle diameter is 7 μm or less, transfer efficiency improves and therefore excellent image quality is obtained.

The toner preferably includes a component having the volume average particle diameter of 2 μm or less in an amount of 1% by number or greater but 10% by number or less.

A ratio of the volume average particle diameter of the toner to the number average particle diameter of the toner is preferably 1.2 or less.

For example, the volume average particle diameter (D4) and number average particle diameter (Dn) of the toner and the ratio thereof (D4/Dn) can be measured by means of Coulter Counter TA-II, Coulter Multisizer II (both available from Beckman Coulter, Inc.), etc. In the present disclosure, Coulter Multisizer II is used. A measuring method will be described hereinafter.

First, from 0.1 mL through 5 mL of a surfactant (preferably polyoxyethylene alkyl ether (nonionic surfactant)) serving as a dispersing agent is added to from 100 mL through 150 mL of an electrolyte aqueous solution. The electrolyte aqueous solution is a 1% by mass NaCl aqueous solution prepared using first grade sodium chloride. For example, ISOTON-II (available from Beckman Coulter, Inc.) is used as the electrolyte aqueous solution. To the mixture above, from 2 mg through 20 mg of a measuring sample is added. The electrolyte aqueous solution in which the sample is suspended is subjected to a dispersion treatment for from about 1 minute to about 3 minutes by an ultrasonic wave disperser. A volume of the toner particles or the toner, and the number of the toner particles are measured by means of the measuring device using a 100 μm aperture as an aperture, to calculate a volume distribution and a number distribution. The volume average particle diameter (D4) and number average particle diameter (Dn) of the toner can be determined from the obtained distributions.

As channels, used are the following 13 channels, i.e., 2.00 μm or greater but less than 2.52 μm; 2.52 μm or greater but less than 3.17 μm; 3.17 μm or greater but less than 4.00 μm; 4.00 μm or greater but less than 5.04 μm; 5.04 μm or greater but less than 6.35 μm; 6.35 μm or greater but less than 8.00 μm; 8.00 μm or greater but less than 10.08 μm; 10.08 μm or greater but less than 12.70 μm; 12.70 μm or greater but less than 16.00 μm; 16.00 μm or greater but less than 20.20 μm; 20.20 μm or greater but less than 25.40 μm; 25.40 μm or greater but less than 32.00 μm; and 32.00 μm or greater but less than 40.30 μm. The particles having the particle diameter of 2.00 μm or greater but less than 40.30 μm are used as a target.

(Production Method of Toner)

A production method of the toner is not particularly limited and may be appropriately selected depending on the intended purpose. The toner is preferably granulated by dispersing an oil phase in an aqueous medium where the oil phase includes at least the amorphous polyester resin, the crystalline polyester resin, the release agent, and the colorant.

Examples of the above-mentioned production method of the toner include a dissolution suspension method known in the art.

As another example of the production method of the toner, described below is a method where toner base particles are formed with generating a product (may be referred to as an "adhesive base" hereinafter) generated through an elongation reaction and/or cross-linking reaction between the active hydrogen group-containing compound and a polymer including a site reactive with the active hydrogen group-containing compound. In this method, preparation of an aqueous medium, preparation of an oil phase including a toner material, emulsification or dispersion of the toner material, and removal of an organic solvent are performed.

The toner base particles are preferably obtained by dissolving and/or dispersing at least a binder resin and a release agent in an organic solvent, adding the obtained solution or dispersion liquid to an aqueous phase, and removing the organic solvent from the obtained dispersion liquid. The toner base particles are more preferably obtained by dissolving and/or dispersing at least a binder resin precursor and a release agent in an organic solvent, adding the obtained solution and/or dispersion liquid to an aqueous phase to allow the binder resin precursor to react through a cross-linking reaction and/or elongation reaction, and removing the organic solvent.

—Preparation of Aqueous Medium (Aqueous Phase)—

For example, preparation of the aqueous medium can be performed by dispersing resin particles in an aqueous medium. An amount of the resin particles added to the aqueous medium is not particularly limited and may be appropriately selected depending on the intended purpose. The amount thereof is preferably 0.5% by mass or greater but 10% by mass or less. The resin particles are not particularly limited and may be appropriately selected depending on the intended purpose. Examples of the resin particles include a surfactant, a poorly water-soluble inorganic compound dispersing agent, and polymer-based protective colloid. The above-listed examples may be used alone or in combination. Among the above-listed examples, a surfactant is preferable.

The aqueous medium is not particularly limited and may be appropriately selected depending on the intended purpose. Examples of the aqueous medium include a water, a solvent miscible with water, and a mixture thereof. The above-listed examples may be used alone or in combination. Among the above-listed examples, water is preferable.

The solvent miscible with water is not particularly limited and may be appropriately selected depending on the intended purpose. Examples thereof include alcohol, dimethylformamide, tetrahydrofuran, cellosolves, and lower ketones.

Examples of the alcohol include methanol, isopropanol, and ethylene glycol.

Examples of the lower ketones include acetone, and methyl ethyl ketone.

—Preparation of Oil Phase—

The preparation of the oil phase including the toner material can be performed by dissolving or dispersing a toner material in an organic solvent, where the toner material includes the active hydrogen group-containing compound, a polymer having a site reactive with the active hydrogen group-containing compound, the crystalline polyester resin, the amorphous polyester resin, the release agent, the hybrid resin, and the colorant.

The organic solvent is not particularly limited and may be appropriately selected depending on the intended purpose. The organic solvent is preferably an organic solvent having a boiling point of lower than 150° C. because such an organic solvent is easily removed.

The organic solvent having a boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. The above-listed examples may be used alone or in combination.

Among the above-listed examples, ethyl acetate, toluene, xylene, benzene, methylene chloride, 1,2-dichloroethane, chloroform, and carbon tetrachloride are preferable, and ethyl acetate is more preferable.

—Emulsification and Dispersion—

Emulsification or dispersion of the toner material can be performed by dispersing the oil phase including the toner material in the aqueous medium. When the toner material is emulsified or dispersed, the active hydrogen group-containing compound and the polymer including a site reactive with the active hydrogen group-containing compound are allowed to react through an elongation reaction and/or cross-linking reaction, to thereby generate an adhesive base.

For example, the adhesive base may be generated by emulsifying or dispersing the oil phase including the polymer reactive with an active hydrogen group (e.g., polyester prepolymer including an isocyanate group) in an aqueous medium together with a compound including an active hydrogen group (e.g., amines), followed by allowing the polymer and the compound to react through an elongation reaction and/or cross-linking reaction in an aqueous medium. The adhesive base may be generated by emulsifying or dispersing an oil phase including a toner material in an aqueous medium to which a compound including an active hydrogen group has been added in advance, followed by allowing the both to react through an elongation reaction and/or cross-linking reaction in an aqueous medium. The adhesive base may be generated by emulsifying or dispersing an oil phase including a toner material in an aqueous medium, followed by adding a compound including an active hydrogen group, and allowing the both to react through an elongation reaction and/or cross-linking reaction starting at an interface of each particle in the aqueous medium. In the case that the both the polymer and the compound are allowed to react through an elongation reaction and/or cross-linking reaction starting at an interface of each particle, a urea-modified polyester resin is preferentially formed at a surface of a generated toner particle to give a concentration gradient of the urea-modified polyester resin in the toner particle.

Reaction conditions (e.g., reaction duration, and a reaction temperature) for generating the adhesive base are not particularly limited and may be appropriately selected depending on a combination of the active hydrogen group-containing compound and the polymer having a site reactive with the active hydrogen group-containing compound.

The reaction duration is not particularly limited and may be appropriately selected depending on the intended purpose. The reaction duration is preferably 10 minutes or longer but 40 hours or shorter, and more preferably 2 hours or longer but 24 hours or shorter.

The reaction temperature is not particularly limited and may be appropriately selected depending on the intended purpose. The reaction temperature is preferably 0° C. or higher but 150° C. or lower, and more preferably 40° C. or higher but 98° C. or lower.

A method for stably forming a dispersion liquid including a polymer having a site reactive with an active hydrogen group-containing compound, such as a polyester prepolymer including an isocyanate group in the aqueous medium is not particularly limited and may be appropriately selected depending on the intended purpose. Examples of the method include a method where an oil phase prepared by dissolving or dispersing a toner material in a solvent is added to an aqueous medium phase, and the resultant is dispersed by shear force.

The disperser used for the dispersing is not particularly limited and may be appropriately selected depending on the intended purpose, Examples of the disperser include a low-speed shearing disperser, a high-speed shearing disperser, a friction disperser, a high-pressure jet disperser, and an ultrasonic disperser.

Among the above-listed examples, a high-speed shearing disperser is preferable because particle diameters of dispersed elements (oil droplets) can be controlled to the range of from 2 μm through 20 μm.

In the case where the high-speed shearing disperser is used, the conditions thereof, such as the rotational speed, dispersion duration, and a dispersion temperature, are appropriately selected depending on the intended purpose.

The rotational speed is not particularly limited and may be appropriately selected depending on the intended purpose. The rotational speed is preferably 1,000 rpm or greater but 30,000 rpm or less, and more preferably 5,000 rpm or greater but 20,000 rpm or less.

The dispersing duration is not particularly limited and may be appropriately selected depending on the intended purpose. In case of a batch system, the dispersing duration is preferably 0.1 minutes or longer but 5 minutes or shorter.

The dispersing temperature is not particularly limited and may be appropriately selected depending on the intended purpose. The dispersing temperature is preferably 0° C. or higher but 150° C. or lower, and more preferably 40° C. or higher but 98° C. or lower under the pressure. Note that, generally, dispersing is more easily performed when the dispersing temperature is a high temperature.

When the toner material is emulsified or dispersed, an amount of the aqueous medium for use is not particularly limited and may be appropriately selected depending on the intended purpose. The amount thereof is preferably 50 parts by mass or greater but 2,000 parts by mass or less, and more preferably 100 parts by mass or greater but 1,000 parts by mass or less, relative to 100 parts by mass of the toner.

When the amount of the aqueous medium for use, the dispersed state of the toner material particles is excellent and toner base particles having the predetermined particle diameters can be obtained. When the amount of the aqueous medium for use is 2,000 parts by mass or less, excellent production cost is achieved.

When the oil phase including the toner material is emulsified or dispersed, a dispersing agent is preferably used in order to stabilize dispersed elements, such as oil droplets, to obtain desired shapes and make a particle size distribution sharp.

The dispersing agent is not particularly limited and may be appropriately selected depending on the intended purpose without any limitation. Examples thereof include a surfactant, poorly water-soluble inorganic compound dispersing agent, and a polymer-based protective colloid. The above-listed examples may be used alone or in combination.

Among the above-listed examples, a surfactant is preferable.

The surfactant is not particularly limited and may be appropriately selected depending on the intended purpose. For example, an anionic surfactant, a cationic surfactant, a nonionic surfactant, or an amphoteric surfactant can be used as the surfactant.

The anionic surfactant is not particularly limited and may be appropriately selected depending on the intended purpose. Examples thereof include alkyl benzene sulfonic acid salt, α-olefin sulfonic acid salt, and phosphoric acid ester. Among the above-listed examples, a surfactant including a fluoroalkyl group is preferable.

A catalyst may be used for an elongation reaction and/or a cross-linking reaction at the time the adhesive base is generated.

The catalyst is not particularly limited and may be appropriately selected depending on the intended purpose. Examples thereof include dibutyl tin laurate, and dioctyl tin laurate.

—Removal of Organic Solvent—

A method for removing the organic solvent from the dispersion liquid, such as the emulsified slurry is not particularly limited and may be appropriately selected depending on the intended purpose. Examples of the method include: a method where an entire reaction system is gradually heated to evaporate an organic solvent inside oil droplets; and a method where a dispersion liquid is sprayed in a dry atmosphere to remove an organic solvent inside oil droplets.

Once the organic solvent is removed, toner base particles are formed. Washing, drying, etc. can be performed on the toner base particles, and classification etc. may be further performed. The classification may be performed by removing a fine particle component by cyclon in a liquid, a decanter, or centrifugation. Alternatively, an operation of the classification may be performed after drying.

The obtained toner base particles may be mixed with particles, such as the external additive, and the charge controlling agent. At the time of the mixing, detachment of the particles, such as the external additive, from surfaces of the toner base particles can be suppressed by applying mechanical impact.

The method for applying the mechanical impact is not particularly limited and may be appropriately selected depending on the intended purpose. Examples of the method include: a method where impact is applied to a mixture using a blade rotating at high speed; and a method where a mixture is added to a high-speed air flow to accelerate and to make particles to crush with each other or crush against an impact board.

A device used for the method is not particularly limited and may be appropriately selected depending on the intended purpose. Examples thereof include an angmill (available from HOSOKAWA MICRON CORPORATION), a device obtained by modifying an I-type mill (available from Nippon Pneumatic Mfg. Co., Ltd.) to reduce pulverization air pressure, a hybridization system (available from NARA MACHINERY CO., LTD.), Kryptron System (available from Kawasaki Heavy Industries, Ltd.), and an automatic mortar.

(Developer)

The developer associated with the present disclosure includes at least the toner, and may further include appropriately selected other component, such as a carrier, according to the necessity.

Therefore, transfer properties, charging ability, etc. are excellent, and an image of a high image quality can be stably formed. Note that, the developer may be a one-component developer or a two-component developer. In the case where the developer is used for a high-speed printer corresponding to a recent improvement of information processing speed, use of a two-component developer is preferable in view of an improvement of service life.

When the developer is used as a one-component developer, there is no or slight change in the particle diameter of the toner even after consuming and refilling the toner, filming of the toner to a developing roller or fusion of the toner to a member, such as a blade for thinning a layer of the toner, is rarely caused, and excellent and stable developing properties and images are obtained even the developer is stirred for a long period in a developing device.

When the developer is used as a two-component developer, there is no or slight change in the particle diameter of the toner even after consuming and refilling the toner, and excellent and stable developing properties and images are obtained even the developer is stirred for a long period in a developing device.

In the case where the toner is used for a two-component developer, the toner may be mixed with the carrier for use. An amount of the carrier in the two-component developer is not particularly limited and may be appropriately selected depending on the intended purpose. The amount thereof is preferably 90% by mass or greater but 98% by mass or less, and more preferably 93% by mass or greater but 97% by mass or less.

<Carrier>

The carrier is not particularly limited and may be appropriately selected depending on the intended purpose. The carrier preferably includes carrier particles each including a core and a resin layer covering the core.

—Cores—

A material of the cores is not particularly limited and may be appropriately selected depending on the intended purpose. Examples thereof include a manganese-strontium-based material of 50 emu/g or greater but 90 emu/g or less, and a manganese-magnesium-based material of 50 emu/g or greater but 90 emu/g or less. In order to ensure a desired image density, moreover, a high magnetic material, such as iron powder (100 emu/g or greater) and magnetite (75 emu/g or greater but 120 emu/g or less), is preferably used. Moreover, a low magnetic material, such as a copper/zinc-based material of 30 emu/g or greater but 80 emu/g or less, is preferably used, because an impact of the developer in the form of a brush to the photoconductor can be weakened, and a high quality image can be formed. The above-listed examples may be used alone or in combination.

The volume average particle diameter of the cores is not particularly limited and may be appropriately selected depending on the intended purpose. The volume average particle diameter thereof is preferably 10 μm or greater but 150 μm or less, and more preferably 40 μm or greater but 100 μm or less. When the volume average particle diameter is 10 μm or greater, an amount of fine powder in the carrier is desirable and reduction in magnetization per particle can be prevented, and therefore carrier scattering can be prevented. When the volume average particle diameter is 150 μm or less, reduction in the specific surface are can be prevented, and toner scattering can be also prevented.

Moreover, reproducibility of a solid image area can be maintained, particularly, in a full-color image including a large solid image area.

—Resin Layer—

A material of the resin layer is not particularly limited and may be appropriately selected depending on the intended purpose. Examples of the material include an amino resin, a polyvinyl resin, a polystyrene resin, polyhalogenated olefin, a polyester resin, a polycarbonate-based resin, polyethylene, polyvinyl fluoride, polyvinylidene fluoride, polytrifluoroethylene, polyhexafluoropropylene, a copolymer of vinylidene fluoride and an acrylic monomer, a copolymer of vinylidene fluoride and vinyl fluoride, and a fluoroterpolymer (e.g., a copolymer of tetrafluoroethylene, vinylidene fluoride, and a monomer free from a fluoro group), and a silicone resin. The above-listed examples may be used alone or in combination.

Examples of the amino resin include a urea-formaldehyde resin, a melamine resin, a benzoguanamine resin, a urea resin, a polyamide resin, and an epoxy resin.

Examples of the polyvinyl resin include an acrylic resin, polymethyl methacrylate, polyacrylonitrile, polyvinyl acetate, polyvinyl alcohol, and polyvinyl butyral.

Examples of the polystyrene resin include polystyrene, and a styrene-acryl copolymer.

Examples of the polyhalogenated olefin include polyvinyl chloride.

Examples of the polyester resin include polyethylene terephthalate, and polybutylene terephthalate.

The resin layer may include conductive powder etc. according to the necessity.

The conductive powder is not particularly limited and may be appropriately selected depending on the intended purpose. Examples thereof include metal powder, carbon black, titanium oxide, tin oxide, and zinc oxide.

The average particle diameter of the conductive powder is preferably 1 μm or less. The conductive powder having the average particle diameter of 1 μm or less is advantageous in view of control of electric resistance.

Examples of a method for forming the resin layer include a formation method where a silicone resin etc. is dissolved in a solvent to prepare a coating liquid, the coating liquid is applied onto surfaces of cores and is dried, and then baking is performed.

The coating method is not particularly limited and may be appropriately selected depending on the intended purpose. Examples thereof include dip coating, spray coating, and brush coating.

The solvent is not particularly limited and may be appropriately selected depending on the intended purpose. Examples of the solvent include toluene, xylene, methyl ethyl ketone, methyl isobutyl ketone, and butyl cellosolve acetate.

The baking may be of an external heating system or an internal heating system. Specific examples thereof include a method using a fixed electric furnace, a fluidized bed electric furnace, a rotary electric furnace, or a burner furnace, and a method using microwaves.

An amount of the resin layer in the carrier is not particularly limited and may be appropriately selected depending on the intended purpose. The amount thereof is preferably 0.01% by mass or greater but 5.0% by mass or less. When the amount of the resin layer is 0.01% by mass or greater, a uniform resin layer can be formed on a surface of a core. When the amount thereof is 5.0% by mass or less, a thickness of the resin layer is appropriate and fusion of carrier particles can be prevented, and therefore uniformity of the carrier can be improved.

<Toner Stored Unit>

A toner stored unit of the present disclosure is a unit that has a function of storing a toner and stores the toner. Examples of embodiments of the toner stored unit include a toner stored container, a developing device, and a process cartridge.

The toner stored container is a container in which a toner is stored.

The developing device is a device including a unit configured to store a toner and develop.

(Process Cartridge)

The process cartridge of the present disclosure is detachably mounted in various image forming apparatuses, and includes at least a photoconductor configured to bear an electrostatic latent image, and a developing unit configured to develop the electrostatic latent image born on the photoconductor with the developer of the present disclosure to form a toner image. Note that, the process cartridge of the present disclosure may further include other units according to the necessity.

The developing unit includes at least a developer stored unit configured to store the developer of the present disclosure, and a developer bearer configured to bear the developer stored in the developer stored unit and to convey the developer. Note that, the developing unit may further include a regulating member configured to regulate a thickness of the developer born.

When the toner stored unit of the present disclosure is mounted in an image forming apparatus and image formation is performed by the image forming apparatus, images having image stability over a long period and having high quality and precision can be formed using the following characteristics of the toner. The characteristics of the toner are that the toner has excellent offset resistance, charging stability, stress resistance, and prevention of background deposition, and an image of high definition and high quality can be provided.

(Image Forming Apparatus and Image Forming Method)

An image forming apparatus of the present disclosure includes at least an electrostatic latent image bearer, an electrostatic latent image forming unit, and a developing unit. The image forming apparatus may further include other units according to the necessity.

An image forming method associated with the present disclosure includes at least an electrostatic latent image forming step and a developing step. The image forming method may further include other steps according to the necessity.

The image forming method is preferably performed by the image forming apparatus. The electrostatic latent image forming step is preferably performed by electrostatic latent image forming unit. The developing step is preferably performed by the developing unit. The above-mentioned other steps are preferably performed by the above-mentioned other units.

The image forming apparatus of the present disclosure more preferably includes an electrostatic latent image bearer, an electrostatic latent image forming unit configured to form an electrostatic latent image on the electrostatic latent image bearer, a developing unit including a toner and configured to develop the electrostatic latent image formed on the electrostatic latent image bearer with the toner to form a toner image, a transferring unit configured to transfer the toner image formed on the electrostatic latent image bearer to a surface of a recording medium, and a fixing unit configured to fix the toner image transferred to the surface of the recording medium.

Moreover, the image forming method of the present disclosure more preferably includes an electrostatic latent image forming step, a developing step, a transferring step, and a fixing step. The electrostatic latent image forming step includes forming an electrostatic latent image on an electrostatic latent image bearer. The developing step includes developing the electrostatic latent image formed on the electrostatic latent image bearer with a toner to form a toner image. The transferring step includes transferring the toner image formed on the electrostatic latent image bearer to a surface of a recording medium. The fixing step include fixing the toner image transferred to the surface of the recording medium.

In the developing unit, the toner is used. Preferably, the toner image may be formed by using a developer including the toner and optionally further including other ingredients, such as a carrier.

<Electrostatic Latent Image Bearer>

A material, structure, and size of the electrostatic latent image bearer (also referred to as a "photoconductor" hereinafter) are not particularly limited and may be appropriately selected from those known in the art. Examples of the material of the electrostatic latent image bearer include inorganic photoconductors (e.g., amorphous silicon and selenium) and organic photoconductors (e.g., polysilane and phthalopolymethine).

<Electrostatic Latent Image Forming Unit>

The electrostatic latent image forming unit is not particularly limited and may be appropriately selected depending on the intended purpose, as long as the electrostatic latent image forming unit is a unit configured to form an electrostatic latent image on the electrostatic latent image bearer. Examples of the electrostatic latent image forming unit include a unit including at least a charging member configured to charge a surface of the electrostatic latent image bearer and an exposure member configured to expose the surface of the electrostatic latent image bearer to imagewise light.

<Developing Unit>

The developing unit is not particularly limited and may be appropriately selected depending on the intended purpose, as long as the developing unit is a developing unit, which is configured to develop the electrostatic latent image formed on the electrostatic latent image bearer to form a visible image and includes a toner.

<Cleaning Unit>

The image forming apparatus of the present disclosure preferably includes a cleaning unit.

As described above, the toner of the present disclosure has excellent cleaning properties. Accordingly, cleaning properties are improved in terms of the following points by using the toner for the image forming apparatus including the cleaning unit.

- Cleaning properties improves because flowability of the toner is controlled by controlling adhesion between toner particles.
- Excellent cleaning quality can be maintained even under severe conditions, such as long service life and high temperature high humidity environments, by controlling properties of the toner after deterioration thereof.
- Since the external additive is sufficiently detached from the toner on a photoconductor when the free external additive amount B (% by mass) satisfies the above-mentioned formula (4), an accumulated layer (dam layer) of the external additive is formed at the nip with the cleaning blade and therefore high cleaning properties can be achieved.

The cleaning unit is not particularly limited and may be appropriately selected depending on the intended purpose, as long as the cleaning unit is a unit configured to remove the toner remained on the photoconductor. Examples of the cleaning unit include a magnetic brush cleaner, an electrostatic brush cleaner, a magnetic roller cleaner, a blade cleaner, a brush cleaner, and a web cleaner.

<Other Units>

Examples of other units include a transferring unit, a fixing unit, a charge-eliminating unit, a recycling unit, and a controlling unit.

Next, an embodiment where a method for forming an image is performed using the image forming apparatus of the present disclosure will be described with reference to FIG. 1.

FIG. 1 illustrates one example of the image forming apparatus of the present disclosure. A color image forming apparatus 100A illustrated in FIG. 1 includes a photoconductor drum 10 (may be referred to as "photoconductor 10" hereinafter) serving as the electrostatic latent image bearer, a charging roller 20 serving as the charging unit, an exposing device 30 serving as the exposing unit, a developing device 40 serving as the developing unit, an intermediate transfer member 50, a cleaning device 60 serving as the cleaning unit including a cleaning blade, and a charge-eliminating lamp 70 serving as the charge-eliminating unit.

The intermediate transfer member 50 is an endless belt supported by 3 rollers 51 disposed inside the intermediate transfer member 50 and can move in the direction indicated with the arrow. Part of the 3 rollers 51 also functions as a transfer bias roller capable of applying the predetermined transfer bias (primary transfer bias) to the intermediate transfer member 50. The cleaning device 90 including a cleaning blade is disposed near the intermediate transfer member 50. Near the intermediate transfer member 50, moreover, the transfer roller 80 serving as the transferring unit capable of applying transfer bias (secondary bias) to transfer (secondary transfer) a developed image (toner image) onto transfer paper P serving as a recording medium is disposed to face the intermediate transfer member 50. At the periphery of the intermediate transfer member 50, the corona charger 52 configured to apply charge to the toner image on the intermediate transfer member 50 is disposed between a contact area between the photoconductor 10 and the intermediate transfer member 50 and a contact area between the intermediate transfer member 50 and the transfer paper P along the rotational direction of the intermediate transfer member 50.

At the periphery of the photoconductor drum 10, a black developing unit 45K, a yellow developing unit 45Y, a magenta developing unit 45M, and a cyan developing unit 45C are disposed to directly face the photoconductor drum 10. Note that, the black developing unit 45K includes a developer stored unit 42K, a developer supply roller 43K, and a developing roller 44K. The yellow developing unit 45Y includes a developer stored unit 42Y, a developer supply roller 43Y, and a developing roller 44Y. The magenta developing unit 45M includes a developer stored unit 42M, a developer supply roller 43M, and a developing roller 44M. The cyan developing unit 45C includes a developer stored unit 42C, a developer supply roller 43C, and a developing roller 44C. Moreover, the developing belt 41 is an endless belt supported by a plurality of belt rollers, and part of the developing belt 41 comes in contact with the electrostatic latent image bearer 10.

In the color image forming apparatus 100A illustrated in FIG. 1, for example, the photoconductor drum 10 is uniformly charged by the charging roller 20. The photoconductor drum 10 is exposed to imagewise light by the exposing device 30 to form an electrostatic latent image on the photoconductor drum 10. The electrostatic latent image formed on the photoconductor drum 10 is developed with a toner supplied from the developing device 40 to form a toner image. The toner image is transferred (primary transferred) onto the intermediate transfer member 50 by voltage applied from the roller 51, and is further transferred (secondary transferred) onto the transfer paper P. As a result, a transfer image is formed on the transfer paper P. Note that, the toner remained on the photoconductor 10 is removed by the cleaning device 60, and the charge of the photoconductor 10 is eliminated by the charge-eliminating lamp 70 once.

Figure 2:
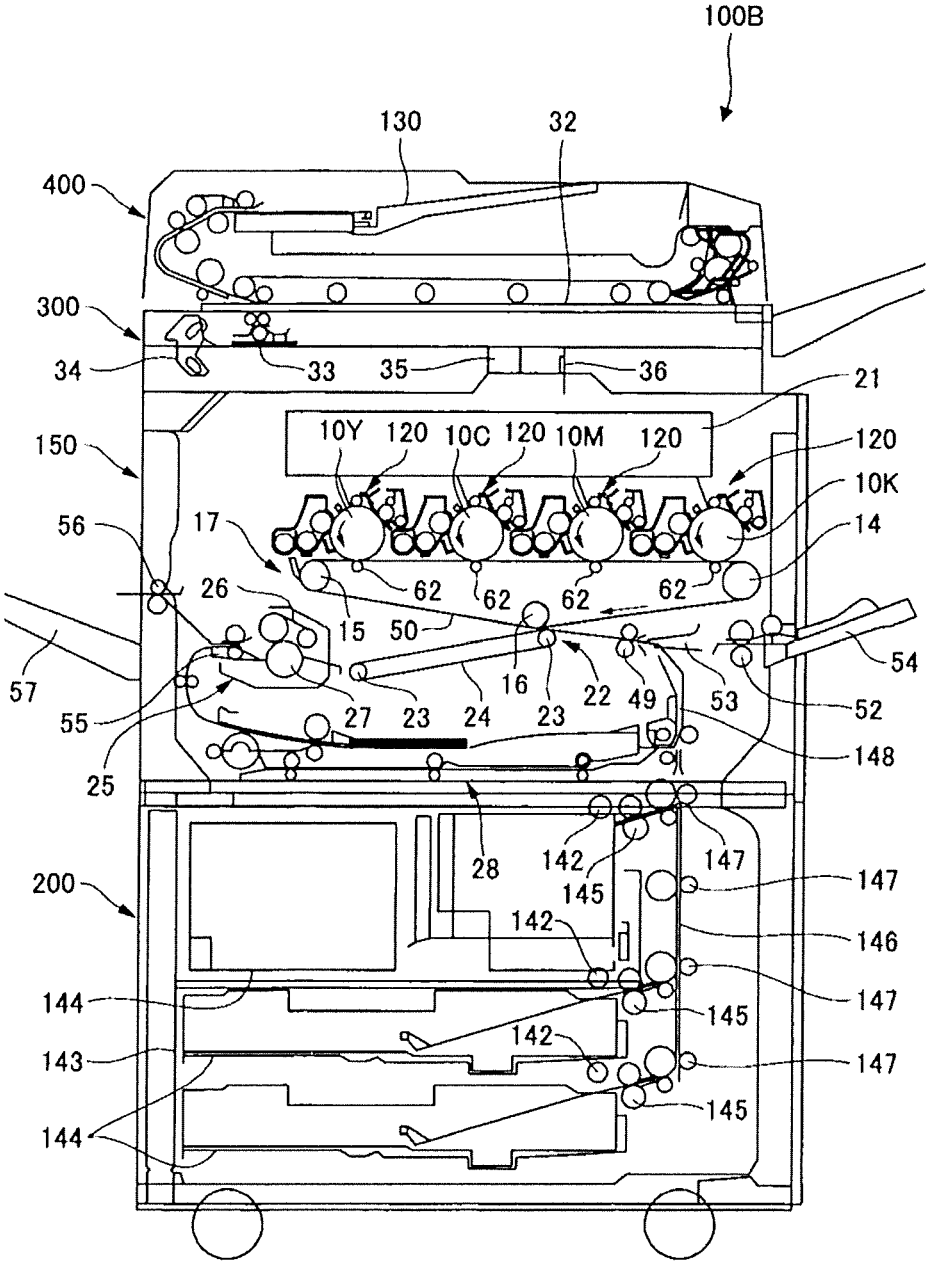
FIG. 2 is a schematic view illustrating another example of the image forming apparatus of the present disclosure.

Another example of the image forming apparatus of the present disclosure is illustrated in FIG. 2. The image forming apparatus 100B illustrated in FIG. 2 includes a copier main body 150, a paper feeding table 200, a scanner 300, and an automatic document feeder (ADF) 400.

An intermediate transfer member 50 in the form of an endless belt is disposed at a center of the copier main body 150. The intermediate transfer member 50 is supported by support rollers 14, 15, and 16, and can rotate in the clockwise direction in FIG. 2. Near the support roller 15, an intermediate transfer member cleaning device 17 configured to remove the toner remained on the intermediate transfer member 50 is disposed. Against the intermediate transfer member 50 supported by the support roller 14 and the support roller 15, a tandem developing device 120 is disposed. In the tandem developing device 120, four image forming units 120 of yellow, cyan, magenta, and black are aligned along the conveying direction of the intermediate transfer member 50 and are disposed to face the intermediate transfer member 50. An exposing device 21 that is the exposing member is disposed near the tandem developing device 120. At the side of the intermediate transfer member 50 opposite to the side thereof where the tandem developing device 120 is disposed, a secondary transferring device 22 is disposed. In the secondary transferring device 22, a secondary transfer belt 24 that is an endless belt is supported by a pair of rollers 23. Transfer paper transported on the secondary transfer belt 24 and the intermediate transfer member 50 can be in contact with each other. A fixing device 25 that is the fixing unit is disposed near the secondary transferring device 22. The fixing device 25 includes a fixing belt 26 that is an endless belt, and a press roller 27 disposed to press against the fixing belt 26.

Note that, a sheet reverser 28 configured to reverse transfer paper to perform image formation on both sides of the transfer paper is disposed near the secondary transferring device 22 and the fixing device 25 in the tandem image forming apparatus.

Next, formation of a full-color image (color copy) using a tandem developing device 120 will be described. First, specifically, a document is set on a document table 130 of an automatic document feeder (ADF) 400. Alternatively, the automatic document feeder 400 is opened, a document is set on contact glass 32 of a scanner 300, and then the automatic document feeder 400 is closed.

In the case where the document is set on the automatic document feeder 400, once a start switch (not illustrated) is pressed, the document is transported onto the contact glass 32, and then the scanner 300 is driven to scan the document with a first carriage 33 and a second carriage 34. In the case where the document is set on the contact glass 32, the scanner 300 is immediately driven to scan the document with the first carriage 33 and the second carriage 34. During the scanning, light emitted from a light source of the first carriage 33 is reflected on a surface of the document, and the reflected light is then reflected by a mirror of the second carriage 34 to pass through an image formation lens 35. The reflected light is then received by a reading sensor 36 to read the color document (color image) to obtain image information of black, yellow, magenta, and cyan.

Figure 3:
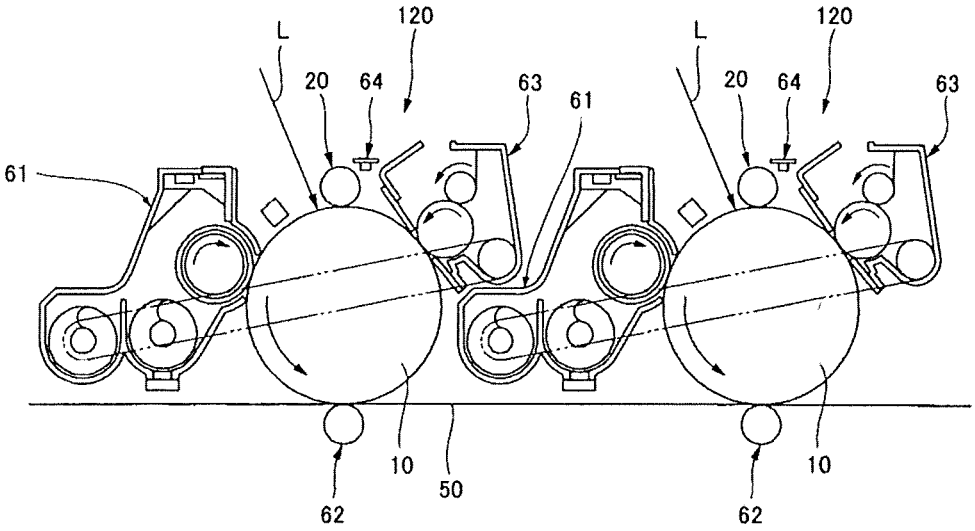
FIG. 3 is an enlarged partial view of the image forming apparatus of FIG. 2.

The image information of black, yellow, magenta, and cyan is respectively transmitted to each of the image forming units 120 (black image forming unit, yellow image forming unit, magenta image forming unit, and cyan image forming unit) of the tandem developing device 120. In each of the image forming units, each of black, yellow, magenta, and cyan toner images is formed. Specifically, each of the image forming units 120 (black image forming unit, yellow image forming unit, magenta image forming unit, and cyan image forming unit) of the tandem developing device 120 includes an electrostatic latent image bearer 10 (black electrostatic latent image bearer 10K, yellow electrostatic latent image bearer 10Y, magenta electrostatic latent image bearer 10M, and cyan electrostatic latent image bearer 10C), a charging device 20 that is the charging unit configured to uniformly charge the electrostatic latent image bearer 10, an exposing device configured to expose the electrostatic latent image bearer with light (L in FIG. 3) imagewise corresponding to each color image based on each color image information to form an electrostatic latent image corresponding to each color image on the electrostatic latent image bearer, a developer 61 that is the developing unit and is configured to develop the electrostatic latent image with each of color toners (black toner, yellow toner, magenta toner, and cyan toner) to form a toner image of each color toner, a transfer charger 62 configured to transfer the toner image onto the intermediate transfer member 50, a cleaning device 63, and a charge-eliminator 64, as illustrated in FIG. 3. In each image forming unit 120, each of single color images (black image, yellow image, magenta image, and cyan image) can be formed based on image information of each color. The black image, the yellow image, the magenta image, and the cyan image formed in the above-described manner are sequentially transferred (primary transferred) on the intermediate transfer member 50 rotatably supported by the support rollers 14, 15, and 16. Specifically, a black image formed on the black electrostatic latent image bearer 10K, a yellow image formed on the yellow electrostatic latent image bearer 10Y, a magenta image forming the magenta electrostatic latent image bearer 10M, and a cyan image formed on the cyan electrostatic latent image bearer 10C are sequentially transferred (primary transferred) onto the intermediate transfer member 50. Then, the black image, the yellow image, the magenta image, and the cyan image are superimposed on the intermediate transfer member 50 to form a composite color image (color transfer image).

In the paper feeding table 200, meanwhile, one of the paper feeding rollers 142 is selectively rotated to eject sheets (recording paper) from one of multiple paper feeding cassettes 144 of the paper bank 143. The sheets are separated one by one by a separation roller 145 to send each sheet to a paper feeding path 146, and then transported by a conveying roller 147 into a paper feeding path 148 within the copier main body 150. The sheet transported in the paper feeding path 148 is then bumped against a registration roller 49 to stop. Alternatively, sheets (recording paper) on a manual-feeding tray 54 are ejected by rotating a paper feeding roller 142, separated one by one by a separation roller 145 to guide into a manual paper feeding path 53, and then bumped against the registration roller 49 to stop. Note that, the registration roller 49 is generally earthed at the time of use, but it may be biased for removing paper dusts of the sheet. Then, the registration roller 49 is rotated synchronously with the movement of the composite color image (color transfer image) formed on the intermediate transfer member 50, to thereby sent the sheet (recording paper) between the intermediate transfer member 50 and the secondary transferring device 22. The composite color image (color transfer image) is then transferred (secondary transferred) onto the sheet (recording paper) by the secondary transferring device 22. As a result, the color image is transferred and formed onto the sheet (recording paper). Note that, the toner remained on the intermediate transfer member 50 after the image transfer is cleaned by the intermediate transfer member cleaning device 17.

The sheet (recording paper) on which the color image is transferred and formed is transported by the secondary transferring device 22 to send to the fixing device 25. In the fixing device 25, the composite color image (color transfer image) is fixed on the sheet (recording paper) by heat and pressure. Thereafter, the traveling path of the sheet (recording paper) is switched by a separation craw 55, ejected by the ejection roller 56 to stack on a paper ejection tray 57. Alternatively, the traveling path of the sheet is switched by the separation craw 55, the sheet is flipped by the sheet reverser 28 and is again guided to the transfer position, and then an image is recorded on the back side of the sheet. Thereafter, the sheet is ejected by the ejecting roller 56 to stack on the paper ejection tray 57.

Figure 4:
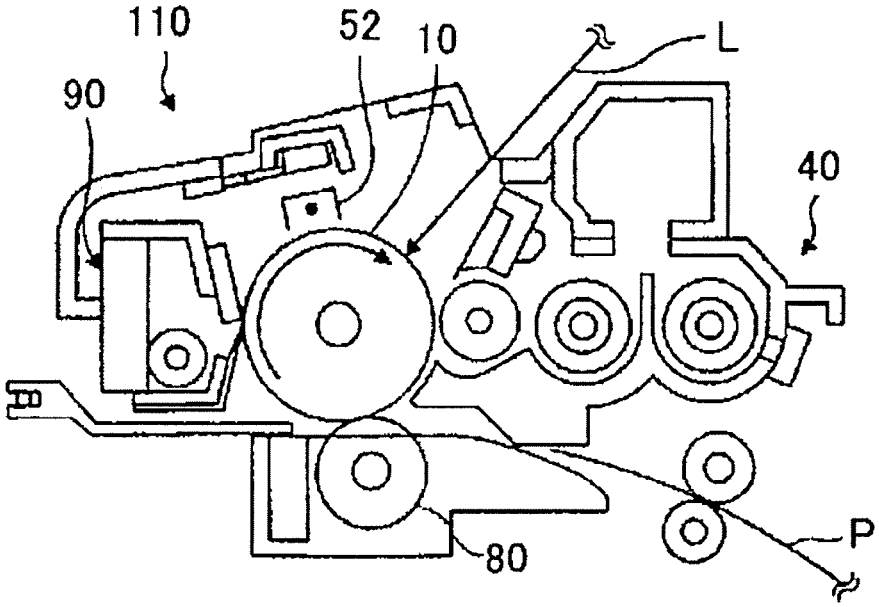
FIG. 4 is a schematic view illustrating one example of a process cartridge.

One example of the process cartridge of the present disclosure is illustrated in FIG. 4. The process cartridge 110 includes a photoconductor drum 10, a corona discharger 52, a developing device 40, a transfer roller 80, and a cleaning device 90.

EXAMPLES

Examples of the present disclosure will be described below. However, it is construed that the present disclosure should not be limited to these Examples.

Note that, measurements of "toner viscoelasticity G'(50), G'(90)," "BET specific surface area Bt," "coverage Ct," "adhesion between deteriorated toner particles A," and "liberated external additive amount B" were performed on each toner in the following manner.

[Toner Viscoelasticity G'(50), G'(90)]

An obtained toner is formed into a pellet having a diameter of 8 mm and a thickness of from 1 mm through 2 mm, and the formed pellet was fixed on a parallel plate having a diameter of 8 mm. Then, the pallet was stabilized at 40° C., followed by heating to 200° C. at the heating rate of 2.0° C./min with a frequency of 1 Hz (6.28 rad/s) and a strain amount of 0.1% (strain amount control mode), to thereby measure storage elastic modulus at 50° C. and 90° C.

The storage elastic modulus was measured by means of a dynamic viscoelasticity measuring device (device name: ARES, available from TA Instruments Inc.).

[BET Specific Surface Area Bt]

After weighing 1.0 g of the toner collected in a sample cell, the toner was vacuum dried for 24 hours using pretreatment Smart Prep (available from Shimadzu Corporation), and impurities and moisture on the surface of the toner were removed. Next, the pretreated toner was set in an automatic specific surface area and porosimetry analyzer. Then, a relationship between a nitrogen gas adsorption amount and relative pressure, to thereby determine BET specific surface area Bt according to multipoint BET.

The BET specific surface area Bt was measured by the automatic specific surface area and porosimetry analyzer (device name: TriStar3000, available from Shimadzu Corporation).

[Coverage Ct]

The obtained toner was observed under a field emission scanning electron microscope (SEM, device name: MERILIN, available from SII Nano Technology Inc.) to obtain a secondary electron image of the toner. The substrate for use was a conductive tape, the SEM was adjusted in a manner that the toner was visualized brighter than the substrate, and the image was obtained by selecting contrast in the manner that there was no areas colored in black and no white foggy areas in the entire image. Next, the obtained image was read in image editing and processing software (GIMP for Windows, registered trademark), and the areas visually judged as the external additive was colored in black (R: 0, G: 0, B: 0). Next, an image ratio A of the areas colored in black by binarization processing to the entire image was obtained. Moreover, the original image read in GIMP for Windows was subjected to binarization processing with a threshold of appropriate brightness, and then an image ratio B of the toner projected image to the entire image was obtained. Next, a ratio (A/B) of the region of the external additive to the projected toner image. The ratio (A/B) was similarly determined on 50 toner particles, and the average value thereof was determined as Ct.

Note that, measuring conditions of SEM were as follows.

Accelerating voltage: 3.0 kV

Working distance (WD): 10.0 mm

[Adhesion A Between Deteriorated Toner Particles]

The developer (30 g) was stirred and mixed for 60 minutes at the frequency of 700 rpm by means of a rocking mill (device name: RM-05S, available from Seiwa Giken) to deteriorate the toner. Next, a cylindrical cell that was divided into two, i.e., an upper part and a lower part, was charged with a certain amount of the powder under the following measuring conditions and the powder was maintained under the pressure of 16 kg/cm$^2$ by means of a compression and tensile properties measuring device for a powder layer (device name: Agglobot, available from HOSOKAWA MICRON CORPORATION), followed by lifting the upper cell to calculate Adhesion A between deteriorated toner particles (compression adhesion) from the strength when the powder layer was broken, the height (distance) at the time f compression, and the volume.

—Measuring Conditions—

Amount of sample: 6 g

Environment temperature: 23° C.

Humidity: 60%

Internal diameter of cell: 25 mm

Cell temperature: 25° C.

Line diameter of spring: 1.0 mm

Compression speed: 0.1 mm/sec

Compressive stress: 16 kg/cm$^2$

Compression retention time: 60 seconds

Tensile speed: 0.01 mm/sec

[Liberated External Additive Amount B]

A 500 mL beaker was charged with 10 g of polyoxyalkylene alkyl ether (product name: NOIGEN ET-165, available from DKS Co., Ltd.) and 300 mL of pure water, and the resultant was dispersed for 1 hour by applying ultrasonic waves, to thereby obtain Dispersion Liquid A. Thereafter, Dispersion Liquid A was transferred into a 2 L measuring flask and was diluted and dissolved by applying ultrasonic waves for 1 hours, to thereby obtain Dispersion Liquid B including 0.5% polyoxyalkylene alkyl ether.

Next, 50 mL of Dispersion Liquid B was poured into a 110 mL screw tube. To Dispersion Liquid B in the screw tube, 3.75 g of the toner that was a sample was added. Stirring was performed for from 30 minutes through 90 minutes until the screw tube was settled with Dispersion Liquid B to thereby obtain Liquid C. During the stirring, the rotational movement was made as small as possible to avoid generation of air bubbles. After sufficiently dispersing the toner, a vibration unit of a ultrasonic homogenizer (device name: VCX750, available from SONICS & Materials, Inc., 20 kHz, 750 W) was inserted in Liquid C by 2.5 cm to apply ultrasonic vibrations for 1 minute at output energy of 40%, to thereby produce Liquid D.

Liquid D was poured into a 50 mL centrifuge tube, and centrifuge separation was performed for 2 minutes at 2,000 rpm, to thereby obtain a supernatant liquid and a precipitate. The precipitate was poured into Sepa-Rohto while washing with 60 mL of pure water, and the washing water was removed by vacuum filtration.

The precipitate obtained after the filtration was again placed in a small cup and 60 mL of pure water was poured into the small cup. The resultant was stirred 5 times with a handle of a spatula. During the stirring, caution was taken not to stir too vigorously. Again, washing water was removed by vacuum filtration and the toner remained on the filter paper was collected, followed by drying the toner for 8 hours in a thermostat chamber of 40° C. After the drying, 3 g of the obtained toner was formed into a pellet having a diameter of 3 mm and a thickness of 2 mm by means of an automatic pressure forming device (device name: T-BRB-32, Maekawa Testing Machine MFG. Co., Ltd., load: 6.0 t, pressurizing duration: 60 seconds), to thereby prepare an after-treatment sample toner.

An initial sample toner on which the above-described treatment had not been performed was similarly formed into a pellet having a diameter of 3 mm and a thickness of 2 mm, and the obtained pellet was used as a pre-treatment sample toner.

The quantitative analysis was performed by means of an X-ray fluorescence spectrometer (device name: ZSX-100e, available from Rigaku Corporation) to measure the number of parts of silica of the toner sample formed into the pellet. Calibration curves for use were created in advance from toner samples including silica in an amount of 0.1 part, 1 part, and 1.8 parts, respectively, relative to 100 parts by mass of the toner.

Thereafter, the liberated external amount B (% by mass) from the toner was calculated by the formula below.

Liberated external additive amount $B$ (% by mass)= [Silica amount (parts) of toner sample before processing−silica amount (parts) of toner sample after processing]/toner sample (parts) before processing×100

Production Example 1-1

<Synthesis of Crystalline Polyester Resin 1>

A reaction vessel to which a nitrogetube, a stirrer, and a thermocouple was charged with sebacic acid and 1,2-ethylene glycol. The amounts thereof were adjusted in a manner that a nolar ratio of hydroxyl groups to carboxyl groups was to be 0.9, and 500 ppm of titanium tetraisopropoxide was added relative to the whole monomers. Next, the resultant mixture was allowed to react for 10 hours at 180° C., followed by heating to 200° C. and reacting for 3 hours. The resultant was allowed to further react for 2 hours under the reduced pressure of 8.3 kPa, to thereby obtain Crystalline Polyester Resin 1. Crystalline Polyester Resin 1 had a melting point of 73° C. and the weight average molecular weight of 20,000.

Production Example 1-2

<Synthesis of Crystalline Polyester Resin 2>

Crystalline Polyester Resin 2 was obtained in the same manner as in [Synthesis of Crystalline Polyester Resin 1], except that 1,2-ethylene glycol was replaced with 1,6-hexanediol. Crystalline Polyester Resin 2 had a melting point of 67° C. and a weight average molecular weight of 25,000.

Production Example 1-3

<Synthesis of Crystalline Polyester Resin 3>

Crystalline Polyester Resin 3 was obtained in the same manner as in [Synthesis of Crystalline Polyester Resin 1], except that 1,2-ethyleneglycol was replaced with 1,10-decanediol. Crystalline Polyester Resin 3 had a melting point of 62° C. and a weight average molecular weight of 28,000.

Production Example 2-1

<Synthesis of Amorphous Polyester Resin 1>

A 5 L four-necked flask equipped with a nitrogen inlet tube, a dehydration tube, a stirrer, and a thermocouple was charged with 1,427.5 g of a bisphenol A propylene oxide (2 mol) adduct, 20.2 g of trimethylol propane, 512.7 g of terephthalic acid, and 119.9 g of adipic acid, and the resultant mixture was allowed to react at 23° C. for 10 hours under normal pressure, followed by further reacting for 5 hours under the reduced pressure of from 10 mmHg through 15 mmHg. Thereafter, 41.0 g of trimellitic anhydride was added to the reaction vessel, the resultant was allowed to react for 3 hours at 180° C. under normal pressure, to thereby obtain Amorphous Polyester Resin 1.

Amorphous Polyester Resin 1 had the weight average molecular weight of 10,000, the number average molecular weight of 2,900, Tg of 57.5° C., and an acid value of 20 mgKOH/g.

Production Example 3-1

<Preparation of Crystalline Polyester Resin Dispersion Liquid 1>

A 2 L metal container was charged with 100 parts of Crystalline Polyester Resin 1 and 200 parts of ethyl acetate, and the resultant mixture was heated and melted at 75° C., followed by quenching in an iced water bath at the rate of 27° C./min. To the resultant, 500 mL of glass beads (diameter: 3 mm) were added, and pulverization was performed for 10 hours by means of a batch-type sand mill (available from Kanpe Hapio Co., Ltd.), to thereby obtain Crystalline Polyester Resin Dispersion Liquid 1.

Production Example 3-2

<Production of Crystalline Polyester Resin Dispersion Liquid 2>

Crystalline Polyester Resin Dispersion Liquid 2 was obtained in the same manner as in Production Example 3-1, except that Crystalline Polyester Resin 1 was replaced with Crystalline Polyester Resin 2.

Production Example 3-3

<Preparation of Crystalline Polyester Resin Dispersion Liquid 3>

Crystalline Polyester Resin Dispersion Liquid 3 was obtained in the same manner as in Production Example 3-1, except that Crystalline Polyester Resin 1 was replaced with Crystalline Polyester Resin 3.

Example 1

—Preparation of Oil Phase—

——Synthesis of Prepolymer——

A reaction vessel equipped with a cooling tube, a stirrer, and a nitrogen inlet tube was charged with 682 parts of a bisphenol A ethylene oxide (2 mol) adduct, 81 parts of a bisphenol A propylene oxide (2 mol) adduct, 283 parts of terephthalic acid, 22 part of trimellitic anhydride, and 2 parts of dibutyl tin oxide. The resultant mixture was allowed to react for 8 hours at 230° C. under normal pressure, followed by further reacting for 5 hours under the reduced pressure of from 10 mmHg through 15 mmHg, to thereby obtain [Intermediate Polyester 1]. [Intermediate Polyester 1] had the weight average molecular weight of 9,500, the number average molecular weight of 2,100, Tg of 55° C., an acid value of 0.5 mgKOH/g, and a hydroxyl value of 51 mgKOH/g.

Next, a reaction vessel equipped with a cooling tube, a stirrer, and a nitrogen inlet tube was charged with 410 parts of [Intermediate Polyester 1], 89 parts of isophorone diisocyanate, and 500 parts of ethyl acetate. The resultant mixture was allowed to react for 5 hours at 100° C., to thereby obtain [Prepolymer 1]. The liberated isocyanate (% by mass) of [Prepolymer 1] was 1.53%.

——Synthesis of Ketimine——

A reaction vessel equipped with a stirring rod and a thermometer was charged with 170 parts of isophorone diamine and 75 parts of methyl ethyl ketone. The resultant mixture was allowed to react for 5 hours at 50° C., to thereby obtain [Ketimine Compound 1]. [Ketimine Compound 1] had the amine value of 418 mgKOH/g.

——Synthesis of Master Batch (MB)——

Water (1,200 parts), 540 parts of carbon black (product name: Printex35, available from Degussa, DBP oil absorption: 42 mL/100 mg, pH: 9.5), and 1,200 parts of Amorphous Polyester Resin 1 were added together and the resultant mixture was mixed by means of HENSCHEL MIXER (available from Nippon Cole & Engineering Co., Ltd.). After kneading the mixture for 30 minutes at 150° C. using a twin-roller kneader, then rolled and cooled, followed by pulverizing the resultant to obtain [Master Batch 1].

——Production of Wax Dispersion Liquid——

A vessel equipped with a stirring rod and a thermometer was charged with 50 parts of paraffin wax (product name: HNP-9, hydrocarbon-based wax, available from Nippon Seiro Co., Ltd., melting point: 75° C., SP value: 8.8) serving as Release Agent 1, and 450 parts of ethyl acetate. The resultant mixture was heated to 80° C. with stirring, and the temperature was maintained at 80° C. for 5 hours. Thereafter, the resultant was cooled to 30° C. over 1 hour. Subsequently, the resultant was dispersed by a bead mill (product name: ULTRA VISCOMILL, available from AIMEX CO., Ltd.) under the conditions that a liquid feeding rate was 1 kg/hr, a disk circumferential velocity was 6 m/sec, zirconia beads each having a diameter of 0.5 mm were packed in the amount of 80% by volume, and the number of passes was 3, to thereby obtain [Wax Dispersion Liquid 1].

A vessel was charged with 500 parts of [Wax Dispersion Liquid 1], 200 parts of [Prepolymer 1], 500 parts of [Crystalline Polyester Resin Dispersion Liquid 2], 750 parts of [Amorphous Polyester Resin 1], 100 parts of [Master Batch 1], and 2 parts of [Ketimine Compound 1] serving as a curing agent. The resultant was mixed by means of TK Homomixer (device name) (available from PRIMIX Corporation) for 60 minutes at 5,000 rpm, to thereby obtain [Oil Phase 1].

—Synthesis of Organic Particle Emulsion (Particle Dispersion Liquid)—

A reaction vessel equipped with a stirring rod and a thermometer was charged with 683 parts of water, 11 parts of sodium salt of sulfuric acid ester of methacrylic acid-ethylene oxide adduct (product name: ELEMINOL RS-30, available from Sanyo Chemical Industries, Ltd.), 138 parts of styrene, 138 parts of methacrylic acid, and 1 part of ammonium persulfate. The resultant mixture was stirred for 15 minutes at 400 rpm/min, to thereby obtain a white emulsion. The white emulsion was heated until the internal system temperature reached 75° C., and was allowed to react for 5 hours. Subsequently, 30 parts of a 1% ammonium persulfate aqueous solution was added to the reaction mixture, followed by aging for 5 hours at 75° C., to thereby obtain an aqueous dispersion liquid of a vinyl-based resin (a copolymer of styrene/methacrylic acid/butyl acrylate/sodium salt of sulfuric acid ester of methacrylic acid ethylene oxide adduct) [Particle Dispersion Liquid 1]. [Particle Dispersion Liquid 1] was measured by LA-920 (device name) (available from HORIBA, Ltd.). As a result, the volume average particle diameter thereof was 0.14 μm. Part of [Particle Dispersion Liquid 1] was dried and the resin component was separated.

—Preparation of Aqueous Phase—

Water (990 parts), 83 parts of [Particle Dispersion Liquid 1], 37 parts of a 48.5% sodium dodecyldiphenyl ether disulfonate aqueous solution (product name: ELEMINOL MON-7, available from Sanyo Chemical Industries, Ltd.), and 90 parts of ethyl acetate were mixed together and stirred to obtain a milky white liquid. The obtained milky white liquid was used as [Aqueous Phase 1].

—Emulsification and Removal of Solvent—

To a vessel in which [Oil Phase 1] was placed, 1,200 parts of [Aqueous Phase 1] was added. The resultant mixture was mixed by TK Homomixer for 20 minutes at the rotational speed of 13,000 rpm, to thereby obtain [Emulsified Slurry 1].

A vessel equipped with a stirrer and a thermometer was charged with [Emulsified Slurry 1], and the solvent therein was removed for 8 hours at 30° C., followed by aging for 4 hours at 45° C., to thereby obtain [Dispersion Slurry 1].

—Washing, Heating Treatment, and Drying—

After filtering 100 parts of [Dispersion Slurry 1] under the reduced pressure, the following processes were performed.

(1): To the filtration cake, 100 parts of ion-exchanged water was added, and the resultant mixture was mixed (for 10 minutes at the rotational speed of 12,000 rpm) by TK Homomixer, followed by filtering the mixture.

(2): To the filtration cake obtained in (1), 100 parts of a 10% by mass sodium hydroxide aqueous solution was added, and the mixture was mixed (for 30 minutes at the rotational speed of 12,000 rpm) by TK Homomixer, followed by filtering the mixture under the reduced pressure.

(3): To the filtration cake obtained in (2), 100 parts of 10% by mass hydrochloric acid was added, and the mixture was mixed (for 10 minutes at the rotational speed of 12,000 rpm) by TK Homomixer, followed by filtering the mixture.

(4): To the filtration cake obtained in (3), 300 parts of ion-exchanged water was added, and the mixture was mixed (for 10 minutes at the rotational speed of 12,000 rpm) by the TK Homomixer, followed by filtering the mixture.

The operations of (1) to (4) above were performed twice in total.

(5): To the filtration obtained in (4), 100 parts of ion-exchanged water was added, the mixture was mixed for 10 minutes at 12,000 rpm by TK Homomixer, and the resultant was heated for 4 hours at 50° C., followed by filtering, to thereby obtain [Filtration Cake 1].

(6): [Filtration Cake 1] was dried by an air-circulating drier for 48 hours at 45° C., and then passed through a sieve with a mesh size of 75 μm, to thereby obtain [Toner Base Particles 1].

By means of HENSCHEL MIXER (available from Nippon Cole & Engineering Co., Ltd.), 100 parts of [Toner Base Particles 1], 0.8 parts of non-spherical hydrophobic silica having the average particle diameter of 140 nm, and 1.0 part of hydrophobic titanium oxide having the average primary particle diameter of 20 nm were mixed, to thereby obtain a toner of Example 1.

Example 2

A toner of Example 2 was obtained in the same manner as in Example 1, except that the amount of the non-spherical hydrophobic silica was changed from 0.8 parts to 1.2 parts.

Example 3

A toner of Example 3 was obtained in the same manner as in Example 1, except that [Crystalline Polyester Resin Dispersion Liquid 1] was replaced with [Crystalline Polyester Resin Dispersion Liquid 2], and the amount of the non-spherical hydrophobic silica was changed from 0.8 parts to 1.5 parts.

Example 4

A toner of Example 4 was obtained in the same manner as in Example 1, except that [Crystalline Polyester Resin Dispersion Liquid 1] was replaced with [Crystalline Polyester Resin Dispersion Liquid 3], and the amount of the non-spherical hydrophobic silica was changed from 0.8 parts to 1.5 parts.

Example 5

A toner of Example 5 was obtained in the same manner as in Example 1, the non-spherical hydrophobic silica having the average particle diameter of 140 nm was replaced with non-spherical hydrophobic silica having the average particle diameter of 130 nm, and the amount of the non-spherical hydrophobic silica was changed from 0.8 parts to 1.5 parts.

Example 6

A toner of Example 6 was obtained in the same manner as in Example 1, except that the amount of the non-spherical hydrophobic silica was changed from 0.8 parts to 2.0 parts.

Comparative Example 1

A toner of Comparative Example 1 was obtained in the same manner as in Example 1, except that the non-spherical hydrophobic silica having the average particle diameter of 140 nm was replaced with non-spherical hydrophobic silica having the average particle diameter of 120 nm, and the amount of the non-spherical hydrophobic silica was changed from 0.8 parts to 1.5 parts.

Comparative Example 2

A toner of Comparative Example 2 was obtained in the same manner as in Example 4, except that the non-spherical hydrophobic silica having the average particle diameter of 140 nm was replaced with spherical hydrophobic silica having the average particle diameter of 140 nm.

Comparative Example 3

A toner of Comparative Example 3 was obtained in the same manner as in Example 4, except that the non-spherical hydrophobic silica having the average particle diameter of 140 nm was replaced with spherical hydrophobic silica having the average particle diameter of 60 nm.

Comparative Example 4

A toner of Comparative Example 4 was obtained in the same manner as in Example 1, except that the non-spherical hydrophobic silica having the average particle diameter of 140 nm was replaced with spherical hydrophobic silica having the average particle diameter of 60 nm, and the amount of the hydrophobic silica was changed from 0.8 parts to 1.5 parts.

Comparative Example 5

A toner of Comparative Example 5 was obtained in the same manner as in Example 1, except that the duration of the heating treatment was changed to 2 hours, and the amount of the non-spherical hydrophobic silica was changed from 0.8 parts to 1.5 parts.

Comparative Example 6

A toner of Comparative Example 6 was obtained in the same manner as in Example 1, except that the duration of the heating treatment was changed to 15 minutes, and the amount of the non-spherical hydrophobic silica was changed from 0.8 parts to 1.5 parts.

Comparative Example 7

A toner of Comparative Example 7 was obtained in the same manner as in Example 1, except that the amount of [Crystalline Polyester Resin Dispersion Liquid 1] was changed from 500 parts to 0 parts, the amount of [Amorphous Polyester Resin 1] was changed from 750 parts to 1,250 parts, and the amount of the non-spherical hydrophobic silica was changed from 0.8 parts to 1.5 parts.

—Production of Developer—

[Carrier] used in combination with the toner in a developer was obtained by applying a coating liquid, in which 200 parts of a silicone resin solution (SR2411, available from Dow Corning Toray Co., Ltd.) and 3 parts of carbon black (Ketjen black EC-DJ600, available from LION SPECIALTY CHEMICALS CO., LTD.) were dispersed in toluene, to 2,500 parts of a ferrite core material (Cu Zn ferrite, magnetization at 1 KOe: 58 emu/g, bulk specific gravity: 2.43 g/cm$^3$) to cover surfaces of particles of the ferrite core material, followed by baking for 2 hours by an electric furnace of 300° C. Note that, the carrier having a relatively sharp particle size distribution and the average particle diameter of from 30 μm through 60 μm was used.

Each of the obtained toners (0.9 parts) and 12 parts of the carrier were mixed and stirred to prepare a developer.

Next, each developer including each of the toners of Examples 1 to 6 and Comparative Examples 1 to 7 was evaluated on "low-temperature fixing ability," "heat resistant storage stability," "durability," and "cleaning." The results are presented in Tables 1 and 2.

<Low-Temperature Fixing Ability>

By means of a device in which a fixing unit of a copier (device name: Imagio MF2200, available from Ricoh Company Limited) was modified using a Teflon (registered trademark) roller as a fixing roller, a copying test was performed on paper (product name: Type 6200 Paper, available from Ricoh Company Limited). A cold offset temperature (minimum fixing temperature) was determined with varying a fixing temperature, and "low-temperature fixing ability" was evaluated based on the evaluation criteria below.

Note that, the evaluation conditions of the minimum fixing temperature were as follows. The linear velocity of paper feeding was from 120 mm/sec through 150 mm/sec, surface pressure was 1.2 kgf/cm$^2$, and the nip width was 3 mm.

—Evaluation Criteria—

A: lower than 115° C.

B: 115° C. or higher or lower than 125° C.

C: 125° C. or higher but lower than 135° C.

D: 135° C. or higher

<Heat Resistant Storage Stability>

A 50 mL glass container was charged with 10 g of the toner, the container was sufficiently tapped until no change in apparent density of the obtained toner powder was observed, and then a lid was placed on the container. After leaving the container in a constant temperature tank of 50° C. for 24 hours, the toner therein was cooled to 24° C. Then, a penetration degree was measured according to a penetration degree test (JIS K2235-1991), and "heat resistant storage stability" was evaluated based on the evaluation criteria below.

Note that, heat resistant storage stability is more excellent as the penetration degree is larger. The toner having the penetration degree of less than 15 mm highly likely to cause a problem on practical use.

—Evaluation Criteria—

A: The penetration degree is 25 mm or greater.

B: The penetration degree is 20 mm or greater but less than 25 mm.

C: The penetration degree is 15 mm or greater but less than 20 mm.

D: The penetration degree is less than 15 mm.

<Durability>

In each of a low-temperature and low-humidity environment (10° C., 15% RH) and a high-temperature and high-humidity environment (27° C., 80% RH), each developer including the toner was loaded in a digital full-color multifunction peripheral (device name: Imagio MP C5000, available from Ricoh Company Limited), and an image having an image area rate of 5% was printed on 500,000 sheets of paper. Next, an entire solid image was printed. Thereafter, the image was visually observed and "durability" was evaluated based on the evaluation criteria below.

—Evaluation Criteria—

A: Liner color missing did not occur.

B: Linear pale color missing slightly occurred (less than 5% of the solid image area).

C: Linear pale color missing occurred (5% or greater but less than 10% of the solid image area).

D: Linear pale color missing significantly occurred (10% or greater of the solid image area), or linear dark color missing occurred.

<Cleaning Properties>

After loading a digital full-color multifunction peripheral (device name: Imagio MP C5000, available from Ricoh Company Limited) with each developer including the toner, a solid image of A4 size was printed with a toner deposition amount of 1.0 mg/cm$^2$. The timing when 1,000 sheets were printed was determined as an initial stage, and the timing when 100,000 sheets were printed was determined as lapse of time. Next, at each timing, the toner remained on the photoconductor passed through the cleaning unit was transferred onto white paper with a scotch tape (available form 3M Japan Limited), reflection density was measured by means of a reflection densitometer (device name: RD514, available from X-Rite Inc.), and "cleaning properties" were evaluated based on the evaluation criteria below.

—Evaluation Criteria—

A: The difference in reflection density between the initial stage and the lapse of time was less than 0.01.

B: The difference in reflection density between the initial stage and the lapse of time was 0.01 or greater but less than 0.025.

C: The difference in reflection density between the initial stage and the lapse of time was 0.025 or greater but less than 0.05.

D: The difference in reflection density between the initial stage and the lapse of time was 0.05 or greater.

TABLE 1

| | | Example | | | | | |
|---|---|---|---|---|---|---|---|
| | | 1 | 2 | 3 | 4 | 5 | 6 |
| Condition (a) | G'(50) | $2.7 \times 10^7$ | $2.7 \times 10^7$ | $2.8 \times 10^7$ | $4.0 \times 10^7$ | $2.7 \times 10^7$ | $2.7 \times 10^7$ |
| | G'(90) | $4.5 \times 10^4$ | $4.5 \times 10^4$ | $4.0 \times 10^4$ | $5.0 \times 10^4$ | $4.5 \times 10^4$ | $4.5 \times 10^4$ |
| | G'(50)/G'(90) | $6.0 \times 10^2$ | $6.0 \times 10^2$ | $7.0 \times 10^2$ | $8.0 \times 10^2$ | $6.0 \times 10^2$ | $6.0 \times 10^2$ |
| Condition (b) | Bt [m$^2$/g] | 2.90 | 3.42 | 3.78 | 3.62 | 3.70 | 3.92 |
| | Ct [%] | 45.0 | 62.0 | 73.3 | 71.3 | 73.3 | 80.3 |
| | Bt-0.03 × Ct | 1.55 | 1.56 | 1.58 | 1.48 | 1.50 | 1.51 |
| Condition (c) | Shape of silica | Non-spherical | Non-spherical | Non-spherical | Non-spherical | Non-spherical | Non-spherical |
| | Silica diameter [nm] | 140 | 140 | 140 | 140 | 130 | 140 |
| Formula (3) | Adhesion A between deteriorated toner particles [gf] | 350 | 300 | 180 | 144 | 253 | 192 |
| Formula (4) | Liberated external additive amount B [mass %] | 0.42 | 0.55 | 0.68 | 0.80 | 1.02 | 1.24 |
| Evaluation result | Low temperature fixing ability | A | A | B | C | A | A |
| | Heat resistant storage stability | C | C | A | A | B | A |
| | Durability (low temperature low humidity environment) | C | B | B | B | A | A |
| | Durability (high temperature high humidity environment) | C | B | B | B | A | A |
| | Cleaning properties | C | C | B | B | A | A |

TABLE 2

| | | Comparative Example | | | | | | |
|---|---|---|---|---|---|---|---|---|
| | | 1 | 2 | 3 | 4 | 5 | 6 | 7 |
| Condition (a) | G'(50) | $2.7 \times 10^7$ | $4.0 \times 10^7$ | $4.0 \times 10^7$ | $2.7 \times 10^7$ | $2.7 \times 10^7$ | $2.7 \times 10^7$ | $2.5 \times 10^7$ |
| | G'(90) | $4.5 \times 10^4$ | $5.0 \times 10^4$ | $5.0 \times 10^4$ | $4.5 \times 10^4$ | $4.5 \times 10^4$ | $4.5 \times 10^4$ | $5.0 \times 10^4$ |
| | G'(50)/G'(90) | $6.0 \times 10^2$ | $8.0 \times 10^2$ | $8.0 \times 10^2$ | $6.0 \times 10^2$ | $6.0 \times 10^2$ | $6.0 \times 10^2$ | $5.0 \times 10^2$ |
| Condition (b) | Bt [m$^2$/g] | 3.75 | 3.60 | 4.25 | 4.05 | 3.85 | 4.80 | 4.20 |
| | Ct [%] | 74.7 | 70.7 | 88.7 | 88.3 | 72.3 | 53.3 | 56.7 |
| | Bt-0.03 × Ct | 1.51 | 1.48 | 1.59 | 1.40 | 1.68 | 3.20 | 2.50 |
| Condition (c) | Shape of silica | Non-spherical | Spherical | Spherical | Spherical | Non-spherical | Non-spherical | Non-spherical |
| | Silica diameter [nm] | 120 | 140 | 60 | 60 | 140 | 140 | 140 |
| Formula (3) | Adhesion A between deteriorated toner particles [gf] | 295 | 305 | 310 | 322 | 310 | 405 | 105 |

TABLE 2-continued

| | | Comparative Example | | | | | | |
|---|---|---|---|---|---|---|---|---|
| | | 1 | 2 | 3 | 4 | 5 | 6 | 7 |
| Formula (4) | Liberated external additive amount B [mass %] | 1.12 | 0.68 | 0.70 | 0.62 | 0.68 | 0.41 | 0.52 |
| Evaluation result | Low temperature fixing ability | A | C | C | A | A | A | D |
| | Heat resistant storage stability | C | D | D | D | D | D | B |
| | Durability (low temperature low humidity environment) | C | C | C | C | C | D | C |
| | Durability (high temperature high humidity environment) | C | C | C | C | C | D | C |
| | Cleaning properties | D | D | D | D | D | D | B |

As presented in Tables 1 and 2, the toners of Examples 1 to 6 were excellent all in the low-temperature fixing ability, heat resistant storage stability, durability, and cleaning properties. Moreover, the low-temperature fixing ability, heat resistant storage stability, durability, and cleaning properties could be improved by controlling the toner viscoelasticity G'(50) and G'(90), BET specific surface area Bt, coverage Ct, shapes of silica particles, particle diameter of the silica, adhesion A between deteriorated toner particles, and liberated external additive amount B.

On the other hand, the toner of Comparative Example 1 had poor heat-resistant storage stability, durability, and cleaning properties because the non-spherical hydrophobic silica having the average particle diameter of 120 nm was used.

Since the toner of Comparative Example 2 used spherical hydrophobic silica, heat resistant storage stability, durability, and cleaning properties were poor.

Since the toner of Comparative Example 3 used spherical hydrophobic silica having the average particle diameter of 60 nm, heat resistant storage stability, durability, and cleaning properties were poor.

Since the toner of Comparative Example 4 used spherical hydrophobic silica having the average particle diameter of 60 nm, and the Adhesion A between deteriorated toner particles was 322 gf, and the liberated external additive amount B was 0.62% by mass, heat resistant storage stability, durability, and cleaning properties were poor.

Since the toner of Comparative Example 5 had the formula (2) (Bt−0.03×Ct) of the condition (b) being 1.68, the Adhesion A between the deteriorated toner particles was 310 gf, and the liberated external additive amount B being 0.68% by mass, heat resistant storage stability, durability, and cleaning properties were poor.

Since the toner of Comparative Example 6 had the formula (2) (Bt−0.03×Ct) of the condition (b) being 3.20, the Adhesion A between deteriorated toner particles being 405 gf, and the liberated external additive amount B being 0.41% by mass, heat resistant storage stability, durability, and cleaning properties were poor.

Since the toner of Comparative Example 7 had the formula (1) (G'(50)/G'(90)) of the condition (a) being $5.0\times10^2$, the formula (2) (Bt−0.03×Ct) of the condition (b) being 2.50, and the liberated external additive amount B being 0.52% by mass, low-temperature fixing ability, durability, and cleaning properties were poor.

For example, embodiments of the present disclosure are as follows.

<1> A toner including:

toner base particles each including a binder resin and a colorant; and external additive;

wherein the toner satisfies conditions (a), (b), and (c) below:

(a) storage elastic modulus G'(50) of the toner at 50° C. and storage elastic modulus G'(90) of the toner at 90° C. satisfy Formula (1):

$$G'(50)/G'(90)\geq 6.0\times10^2 \quad \text{Formula (1)}$$

(b) a BET specific surface area Bt($m^2$/g) of the toner and a coverage Ct (%) of the toner base particles covered with the external additive satisfy Formula (2):

$$Bt-0.03\times Ct\leq 1.60 \quad \text{Formula (2)}$$

(c) the external additive includes at least cohered particles, the cohered particles are non-spherical secondary particles each formed through cohesion of primary particles, and a number average secondary particle diameter of the cohered particles is 130 nm or greater.

<2> The toner according to <1>, wherein an amount B (% by mass) of the external additive liberated from the toner satisfies Formula (4), $$B>0.8 \quad \text{Formula (4)}$$

where the amount B of the liberated external additive is an amount of the external additive liberated from the toner when 3.75 g of the toner is dispersed in 50 mL of a 0.5% by mass polyoxyalkylene alkyl ether dispersion liquid in a 110 mL vial and applying ultrasonic wave vibrations for 1 minute at 20 kHz and 750 W.

<3> An image forming apparatus including:

an electrostatic latent image bearing member;

an electrostatic latent image forming unit configured to form an electrostatic latent image on the electrostatic latent image bearing member;

a developing unit configured to develop the electrostatic latent image formed on the electrostatic latent image bearing member with a toner to form a toner image, where the developing unit stores therein the toner;

a transferring unit configured to transfer the toner image formed on the electrostatic latent image bearing member to a surface of a recording medium; and a fixing unit configured to fix the toner image transferred onto the recording medium, wherein the toner is the toner according to any of <1> or <2>.

<4> The image forming apparatus according to <3>, further including a cleaning unit configured to remove the toner remained on the electrostatic latent image bearing member.

<5> An image forming method including:

forming an electrostatic latent image on an electrostatic latent image bearing member;

developing the electrostatic latent image formed on the electrostatic latent image bearing member with a toner to form a toner image;

transferring the toner image formed on the electrostatic latent image bearing member to a surface of a recording medium; and fixing the toner image transferred onto the surface of the recording medium, wherein the toner is the toner according to any of <1> or <2>.

<6> A process cartridge including:

an electrostatic latent image bearing member; and a developing unit configured to develop an electrostatic latent image formed on the electrostatic latent image bearing member with the toner according to any of <1> or <2> to form a toner image, where the developing unit stores therein the toner.

The toner according to <1> or <2>, the image forming apparatus according to <3> or <4>, the image forming method according to <5>, and the process cartridge according to <6> can solve the above-described various problems existing in the art and can solve the object of the present disclosure.

What is claimed is:

1. A toner comprising:

toner base particles each including a binder resin and a colorant; and external additive;

wherein the toner satisfies conditions (a), (b), and (c) below:

(a) storage elastic modulus G'(50) of the toner at 50° C. and storage elastic modulus G'(90) of the toner at 90° C. satisfy Formula (1):

$$G'(50)/G'(90) \geq 6.0 \times 10^2 \quad \text{Formula (1)}$$

(b) a BET specific surface area Bt($m^2$/g) of the toner and a coverage Ct (%) of the toner base particles covered with the external additive satisfy Formula (2):

$$Bt - 0.03 \times Ct \leq 1.60 \quad \text{Formula (2)}$$

(c) the external additive includes at least cohered particles, the cohered particles are non-spherical secondary particles each formed through cohesion of primary particles, and a number average secondary particle diameter of the cohered particles is 130 nm or greater.

2. The toner according to claim 1, wherein an amount B (% by mass) of the external additive liberated from the toner satisfies Formula (4), $$B > 0.8 \quad \text{Formula (4)}$$

where the amount B of the liberated external additive is an amount of the external additive liberated from the toner when 3.75 g of the toner is dispersed in 50 mL of a 0.5% by mass polyoxyalkylene alkyl ether dispersion liquid in a 110 mL vial and applying ultrasonic wave vibrations for 1 minute at 20 kHz and 750 W.

3. An image forming apparatus comprising:

an electrostatic latent image bearing member;

an electrostatic latent image forming unit configured to form an electrostatic latent image on the electrostatic latent image bearing member;

a developing unit configured to develop the electrostatic latent image formed on the electrostatic latent image bearing member with a toner to form a toner image, where the developing unit stores therein the toner;

a transferring unit configured to transfer the toner image formed on the electrostatic latent image bearing member to a surface of a recording medium; and a fixing unit configured to fix the toner image transferred onto the recording medium, wherein the toner is the toner according to claim 1.

4. The image forming apparatus according to claim 3, further comprising a cleaning unit configured to remove the toner remained on the electrostatic latent image bearing member.

5. An image forming method comprising:

forming an electrostatic latent image on an electrostatic latent image bearing member;

developing the electrostatic latent image formed on the electrostatic latent image bearing member with a toner to form a toner image;

transferring the toner image formed on the electrostatic latent image bearing member to a surface of a recording medium; and fixing the toner image transferred onto the surface of the recording medium, wherein the toner is the toner according to claim 1.

6. A process cartridge comprising:

an electrostatic latent image bearing member; and a developing unit configured to develop an electrostatic latent image formed on the electrostatic latent image bearing member with the toner according to claim 1 to form a toner image, where the developing unit stores therein the toner.

* * * * *